US008882251B2

(12) United States Patent
Aoki

(10) Patent No.: US 8,882,251 B2
(45) Date of Patent: Nov. 11, 2014

(54) INTER-TERMINAL CONNECTION STRUCTURE, LIQUID STORAGE CONTAINER, AND METHOD OF ASSEMBLING LIQUID STORAGE CONTAINER

(75) Inventor: Yuji Aoki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 356 days.

(21) Appl. No.: 13/026,196

(22) Filed: Feb. 11, 2011

(65) Prior Publication Data

US 2011/0198360 A1 Aug. 18, 2011

(30) Foreign Application Priority Data

Feb. 12, 2010 (JP) ..... 2010-028754

(51) Int. Cl.
*B41J 2/175* (2006.01)

(52) U.S. Cl.
CPC ..... *B41J 2/1753* (2013.01); *B41J 2002/17579* (2013.01); *B41J 2002/17516* (2013.01)
USPC ..... 347/86; 347/84; 347/85

(58) Field of Classification Search
USPC ..... 347/84–86, 7; 399/90
See application file for complete search history.

(56) References Cited

U.S. PATENT DOCUMENTS 5,400,066 A 3/1995 Matsumoto et al.
2001/0033316 A1 10/2001 Eida
2004/0130583 A1 7/2004 Seino et al.
2006/0250426 A1* 11/2006 Wanibe et al. ..... 347/7
2007/0008365 A1 1/2007 Lee et al.
2007/0154232 A1* 7/2007 Buchanan et al. ..... 399/90
2009/0051746 A1* 2/2009 Asauchi ..... 347/86
2011/0199439 A1 8/2011 Aoki

FOREIGN PATENT DOCUMENTS

EP 1555128 A1 7/2005
JP 2008-155596 A 7/2008

* cited by examiner

*Primary Examiner* — Manish S Shah
*Assistant Examiner* — Yaovi Ameh
(74) *Attorney, Agent, or Firm* — Kilpatrick Townsend & Stockton LLP

(57) ABSTRACT

An inter-terminal connection structure includes: a first terminal; a second terminal which is separated from the first terminal and is mounted on a container main body for storing a liquid storage body; a first connection member which is in contact with the first terminal, is mounted on the liquid storage body, and has conductivity; and a second connection member which is for connection to the second terminal, is mounted on the container main body, and has conductivity, wherein, when the liquid storage body is accommodated in the container main body, in order to cause the first connection member to come in contact with a first contact portion of the second connection member, the container main body has a positioning member for determining a position of a first site of the first contact portion which is to come in contact with the first connection member inside the container main body.

11 Claims, 14 Drawing Sheets

INTER-TERMINAL CONNECTION STRUCTURE, LIQUID STORAGE CONTAINER, AND METHOD OF ASSEMBLING LIQUID STORAGE CONTAINER

This application claims priority to Japanese Patent Application No. 2010-028754, filed Feb. 12, 2010, the entirety of which is incorporated by reference herein.

BACKGROUND

1. Technical Field

The present invention relates to an inter-terminal connection structure for electrically connecting two terminals which are separated from each other, a liquid storage container having the two terminals which are separated from each other, and a method of assembling the liquid storage container.

2. Related Art

A liquid ejecting apparatus such as an ink jet-type recording apparatus, an ink jet printing apparatus, or a micro-dispenser is supplied with liquid such as ink from a liquid storage container and ejects the liquid. When the ejecting operation is performed in a state where the amount of the residual liquid in the liquid storage container is small and thus the liquid is not supplied to the liquid ejecting apparatus from the liquid storage container, known as firing a blank occurs, and there may be a case where an ejection head is damaged. Accordingly, the amount of the liquid stored in the liquid storage body needs to be detected and monitored.

Here, there is proposed an ink cartridge as a liquid storage container which is equipped with a sensor for detecting a residual amount of liquid and a circuit board for controlling the sensor (for example, JP-A-2008-155596). The ink cartridge described in JP-A-2008-155596 includes a sensor member stored in a container main body and the circuit board mounted on the container main body. A terminal provided in the sensor member (sensor terminal) and a terminal provided in the circuit board (board terminal) are separated from each other. Therefore, in order to electrically connect the terminals which are separated from each other, two members including a board-side terminal conductive member and a sensor-side terminal conductive member are used.

SUMMARY

However, in the description of JP-A-2008-155596, in order to connect the two terminals, after an operation of storing the sensor member (specifically a liquid residual amount detecting unit) in the container main body, an operation of causing the sensor-side terminal conductive member which is in contact with the sensor terminal to come in contact with the board-side terminal conductive member is additionally needed. Accordingly, operations of assembling the liquid storage container become complicated and there may be a case where assembly efficiency (productivity) is degraded.

An advantage of some aspects of the invention is that it provides a technique of easily performing electrical connection between two terminals which are separated from each other thereby enhancing the efficiency of assembling a liquid storage container.

The invention is made to solve at least a part of the problems described above and is implemented as the following embodiments or application examples.

Application Example 1

There is provided an inter-terminal connection structure for electrically connecting two terminals which are separated from each other, including: a first terminal mounted on a liquid storage body for storing a liquid; a second terminal which is separated from the first terminal and is mounted on a container main body for storing the liquid storage body; a first connection member which is in contact with the first terminal, is mounted on the liquid storage body, and has conductivity; and a second connection member which is for connection to the second terminal, is mounted on the container main body, and has conductivity, wherein, when the liquid storage body is accommodated in the container main body, in order to cause the first connection member to come in contact with a first contact portion of the second connection member, the container main body has a positioning member for determining a position of a first site of the first contact portion which is to come in contact with the first connection member inside the container main body.

In the inter-terminal connection structure according to Application Example 1, since the position of the first site is determined by the positioning member, so that the first connection member and the second connection member can be easily made to contact each other by storing the liquid storage body in the container main body. Accordingly, after the liquid storage body is stored in the container main body, an additional operation of causing the first connection member and the second connection member to come in contact with each other is not needed, thereby enhancing assembly efficiency of the liquid storage container.

Application Example 2

In the inter-terminal connection structure according to Application Example 1, the container main body has a bottom face, the second connection member has elasticity, and in a case where the liquid storage body is stored in the container main body, as the first connection member presses the first contact portion of the second connection member against the bottom face, elastic deformation of the first contact portion with respect to a direction perpendicular to the bottom face is limited.

In the inter-terminal connection structure according to Application Example 2, the first and second connection members come in contact with each other as the first connection member presses the first contact portion of the second connection member against the bottom face. Accordingly, even if an impact is exerted on the liquid storage container from the outside, the movement of the first contact portion with respect to the first connection member is suppressed. Accordingly, failure of conduction between the first and second terminals can be reduced.

Application Example 3

In the inter-terminal connection structure according to Application Example 2, the first contact position is able to elastically deform on a first plane which is parallel to the bottom face, in a state where the second connection member is stored in the container main body and the liquid storage body is not stored in the container main body, the first connection member is stored in the container main body as being moved in a direction perpendicular to the first plane, and the positioning member holds the second connection member in the container main body as being in contact with the first contact portion, and determines the position of the first site on the first plane by limiting the elastic deformation of the first contact portion on the first plane.

In the inter-terminal connection structure according to Application Example 3, the elastic deformation of the first contact portion of the second connection member on the first plane is limited by the positioning member, so that the first site of the first contact portion can be disposed at the predetermined position on the first plane. Accordingly, the first and second connection members can be easily made to contact each other, thereby enhancing the assembly efficiency of the liquid storage container.

Application Example 4

In the inter-terminal connection structure according to any one of Application Examples 1 to 3, in a state where the liquid storage body is stored in the container main body, by the first connection member and the positioning member which cooperate with each other, the movement of the first contact portion of the second connection member is limited to a predetermined range.

In the inter-terminal connection structure according to Application Example 4, the movement of the first contact portion can be limited, so that failure of the conduction between the first and second terminals which occurs due to an impact exerted on the liquid storage container from the outside can be reduced.

Application Example 5

In the inter-terminal connection structure according to Application Example 4, in the state where the liquid storage body is stored in the container main body, as viewed along the first contact portion in a direction extending toward the first connection member, a predetermined region is formed by the positioning member and the first connection member, a contact point of the first connection member and the second connection member is included in the predetermined region, and the predetermined region is formed as at least a direction other than the movement direction of the first connection member when the liquid storage body is stored in the container main body is enclosed by the positioning member and the first connection member.

In the inter-terminal connection structure according to Application Example 5, the predetermined region is formed by the positioning member and the first connection member, and the first and second connection member are in contact with each other in the predetermined region. Therefore, even when an impact is exerted on the liquid storage container from the outside, a change in position of the first contact portion with respect to the second connection member can be limited to the predetermined range. Accordingly, contact between the first and second connection members can be properly maintained, thereby further reducing failure of the conduction between the first and second terminals.

Application Example 6

In the inter-terminal connection structure according to Application Example 1, the second connection member is a torsion coil spring having a coil portion, a first arm portion for contacting the second terminal, and the first contact portion as a second arm portion for contacting the first connection member, and the positioning member includes a first protruding portion to be inserted into the coil portion, and a second protruding position for determining the position of the first site as being in contact with the second arm portion.

In the inter-terminal connection structure according to Application Example 6, by providing the two protruding portions in the container main body and using the torsion coil spring for the second connection member, the first and second connection members can be easily made to contact each other. That is, by employing a simple configuration in which the protruding portion for limiting the elastic deformation of the torsion coil spring provided in the container main body, the assembly efficiency of the liquid storage container can be enhanced.

Application Example 7

In the inter-terminal connection structure according to Application Example 6, the container main body has the bottom face, and a side which is connected to the bottom face and on which the second terminal is mounted, the first connection member has a second contact portion which is in contact with the first terminal and a third contact portion to be in contact with the second connection member, in the state where the liquid storage body is stored in the container main body, the second contact portion which is in contact with the first terminal is parallel to the bottom face, in the state where the liquid storage body is stored in the container main body, the third contact portion has a side portion extending in a direction away from the bottom face from the second contact portion, and an upper portion which extends in a direction parallel to the bottom face from the side portion and presses the second arm portion against the bottom face, and by the side portion and the second protruding portion which cooperate with each other, the movement of the second arm portion with respect to a direction parallel to the bottom face and parallel to the side is limited to a predetermined range.

In the inter-terminal connection structure according to Application Example 7, the movement of the second arm portion for contacting the first connection member can be limited, so that contact between the first and second connection members can be properly maintained. Accordingly, failure of the conduction between the first and second terminals can be reduced.

Application Example 8

In the inter-terminal connection structure according to Application Example 7, in the state where the liquid storage body is stored in the container main body, as viewed along the second arm portion of the second connection member in a direction extending toward the first connection member, a predetermined region is formed by the second protruding portion and the third contact portion of the first connection member, a contact point of the first connection member and the second connection member is included in the predetermined region, and the predetermined region is formed as at least a direction other than the movement direction of the first connection member when the liquid storage body is stored in the container main body is enclosed by the second protruding portion and the third contact portion.

In the inter-terminal connection structure according to Application Example 8, the predetermined region is formed by the second protruding portion and the third contact portion, and the first and second connection members are in contact with each other in the predetermined region. Therefore, even when an impact is exerted on the liquid storage container from the outside, a change in position of the second arm portion with respect to the third contact portion can be limited to the predetermined range. Accordingly, failure of the conduction between the first and second terminals can be reduced.

Application Example 9

In the inter-terminal connection structure according to any one of Application Examples 6 to 8, the second arm portion has a bent portion which is bent to a position with the contact point of the first connection member and the second connection member from the coil portion interposed, and in the state where the liquid storage body is stored in the container main body, as viewed along the second arm portion of the second connection member in a direction extending toward the third contact portion of the first connection member, a part of the bent portion overlaps with the third contact portion.

In the inter-terminal connection structure according to Application Example 9, even when an impact is exerted on the liquid storage container from the outside and a position of the second arm portion with respect to the first connection member is temporarily changed, the bent portion is hooked on the first connection member, so that contact between the first and second connection members can be maintained more reliably. Accordingly, failure of the conduction between the first and second terminals can further be reduced.

Application Example 10

In the inter-terminal connection structure according to Application Example 1, the second connection member further has an elastic portion which is extensible, the positioning member has a holding portion on which the elastic portion is mounted, and as the elastic portion is mounted on the holding portion, the elastic portion is deformed such that the second connection member comes in contact with the second terminal mounted on the container main body.

In the inter-terminal connection structure according to Application Example 10, the second connection member can be made to contact the second terminal by mounting the elastic portion on the holding portion. Accordingly, the assembly efficiency of the liquid storage container can further be enhanced.

Application Example 11

In the inter-terminal connection structure according to Application Example 10, the second connection member is a wire worked spring which includes an elastic portion having first and second bent points, a first arm portion extending from one end side of the elastic portion, and a second arm portion extending from the other end side of the elastic portion, the container main body has the bottom face and a side which is connected to the bottom face and on which the second terminal is mounted, and as the first and second bent points come in contact with the holding portion and the elastic portion is mounted on the holding portion, the distance between the first and second bent points becomes greater than that before the mounting, and the first arm portion comes in contact with the second terminal.

In the inter-terminal connection structure according to Application Example 11, by providing the protruding portion having the holding portion in the container main body and using the wire worked spring having a predetermined shape, the second connection member is easily made to contact the second terminal. Accordingly, the assembly efficiency of the liquid storage container can further be enhanced.

Application Example 12

In the inter-terminal connection structure according to any one of Application Examples 1 to 11, the first terminal is a terminal which is provided in a sensor portion used for detecting the amount of liquid stored in the liquid storage body and to which a detection signal is output by the sensor portion, and the second terminal is a terminal which is provided in a circuit board mounted on the container main body and to which a drive signal for driving the sensor portion is output.

In the inter-terminal connection structure according to any one of Application Example 12, by properly maintaining the conduction between the terminal of the circuit board and the terminal of the sensor portion, a situation where a residual amount of liquid may not be detected can be prevented.

Application Example 13

In the inter-terminal connection structure according to any one of Application Examples 1 to 12, the liquid storage body includes: a liquid storage unit for storing the liquid; and a liquid supply unit of which one end is connected to the liquid storage unit and the other end is open to the outside, and which is used for supplying the liquid from the liquid storage unit to a liquid ejecting apparatus.

In the inter-terminal connection structure according to Application Example 13, it is possible to provide the liquid storage container which is able to reduce failure of the conduction between the two terminals.

Application Example 14

There is provided a method of assembling a liquid storage container for supplying a liquid to a liquid ejecting apparatus, including: storing a second connection member having conductivity in a container main body having a bottom face, and causing the second connection member to come in contact with a second terminal mounted on the container main body; disposing a first site of the second connection member at a predetermined position inside the container main body by causing the second connection member to come in contact with a positioning member provided in the container main body; and storing a liquid storage body which is used for storing a liquid and has a first terminal and a first connection member which is in contact with the first terminal and has conductivity, in the container main body, wherein in storing the liquid storage body, when the container main body is stored in the liquid storage body, the first connection member is caused to come in contact with the second connection member by allowing a predetermined site of the first connection member to pass through the predetermined position.

In the method according to Application Example 14, by storing the liquid storage body in the container main body, the first and second connection members can be made to contact each other. Accordingly, after the liquid storage body is stored in the container main body, an additional operation of causing the first and second connection members to come in contact with each other is not needed, thereby enhancing the assembly efficiency of the liquid storage container.

Application Example 15

In the method according to Application Example 14, the container main body has a side which is connected to the bottom face and on which the second terminal is mounted, the second connection member is a torsion coil spring which has a coil portion, a first arm portion, and a second arm portion, the positioning member has a first protruding portion and a second protruding portion, the storing of the second connection member includes inserting the first protruding portion through the coil portion, and causing the first arm portion to come in contact with the second terminal, the disposing of the first site of the second connection member includes limiting elastic deformation of the second arm portion on a first plane parallel to the bottom face by hooking the second arm portion on the second protruding portion, and the storing of the liquid storage body includes causing the second arm portion to come in contact with the first connection member by storing the liquid storage body in the container main body.

In the method according to Application Example 15, by using the torsion coil spring for the second connection member and providing the predetermined protruding portion in the container main body, the assembly efficiency of the liquid storage container can be enhanced.

Application Example 16

In the method according to Application Example 14, the container main body has a side which is connected to the bottom face and on which the second terminal is mounted, the second connection member is a wire worked spring which includes an elastic portion which is extensible, a first arm portion extending from one end side of the elastic portion, and a second arm portion extending from the other end side of the elastic portion, the positioning member has a holding portion on which the elastic portion is mounted, the storing of the second connection member is causing the first arm portion to come in contact with the second terminal by mounting the elastic portion on the holding portion and deforming the elastic portion, and the disposing of the first site of the second connection member is disposing the first site of the second connection member disposed at a predetermined position in the container main body.

In the method according to Application Example 16, by using the wire worked spring having a predetermined shape for the second connection member and providing the holding portion for deforming the elastic portion in the container main body, the second connection member is easily made to contact the second terminal. Accordingly, the assembly efficiency of the liquid storage container can further be enhanced.

Moreover, the invention can be modified into various forms, and can be implemented as, in addition to the inter-terminal connection structure described above, the liquid storage container having the inter-terminal connection structure, and the method of assembling the liquid storage container, liquid ejecting apparatuses having the liquid storage container.

BRIEF DESCRIPTION OF THE DRAWINGS

The invention will be described with reference to the accompanying drawings, wherein like numbers reference like elements.

DESCRIPTION OF EXEMPLARY EMBODIMENTS

Now, an embodiment of the invention will be described in the following order.

A. First Embodiment:

B. Second Embodiment:

C. Modified Example:

A. First Embodiment

A-1. Overall Configuration of Ink Cartridge

Figure 1:
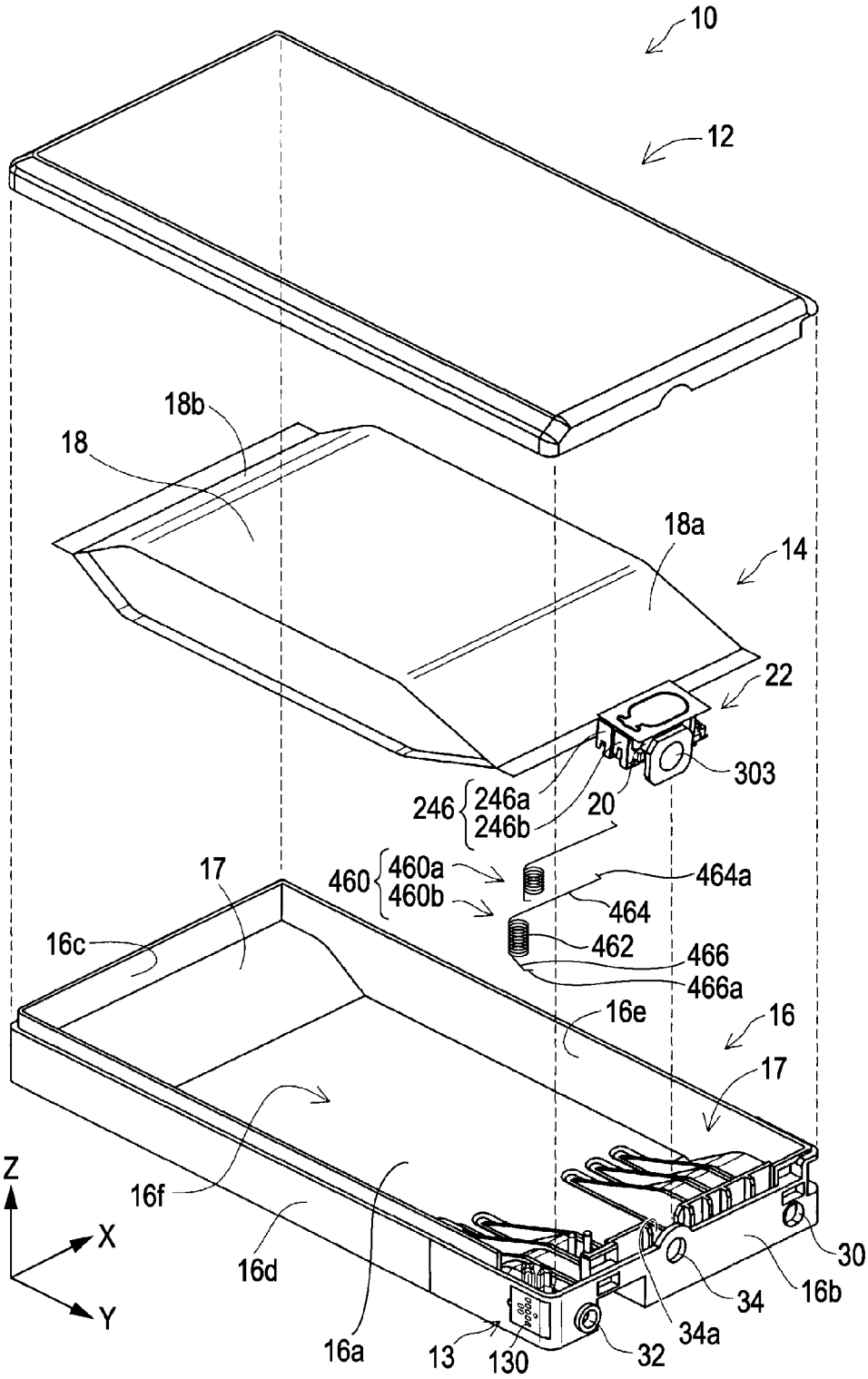
FIG. 1 is a perspective view of an outer appearance of an ink cartridge according to a first embodiment of the invention.

FIG. 1 is a perspective view of an outer appearance of an ink cartridge according to a first embodiment of the invention. In FIG. 1, in order to specify directions, X, Y, and Z-axes are illustrated. An ink cartridge 10 includes a first case 12, a second case 16, a liquid storage body (also called an "ink pack") 14, and two board-side connection members 460*a* and 460*b* having conductivity. The ink pack 14 is stored in the second case 16, and the first case 12 is mounted on the second case 16, thereby assembling the ink cartridge 10 which is a liquid storage container. In addition, in the specification, in a case where there is no need to distinguish between the two board-side connection members 460*a* and 460*b* in use, they are simply called a board-side connection member 460. In addition, the ink cartridge 10 supplies ink to a printer through suction from the printer. Here, the second case 16 corresponds to a container main body described in summary.

By the board-side connection member 460 and a sensor-side connection members 246*a* and 246*b* mounted on a liquid detecting unit 22, a board terminal (not shown) of a circuit board 13 mounted on the second case 16 and a sensor terminal (not shown) of a liquid detecting unit 22 are electrically connected to each other. In addition, according to the specification, in a case where there is no need to distinguish between the two sensor-side connection members 246*a* and 246*b* in use, they are simply called a sensor-side connection member 246. Hereinafter, for ease of understanding, with reference to FIG. 2, an inter-terminal connection mode using the connection members 246 and 460 according to the first embodiment will be described.

Figure 2:
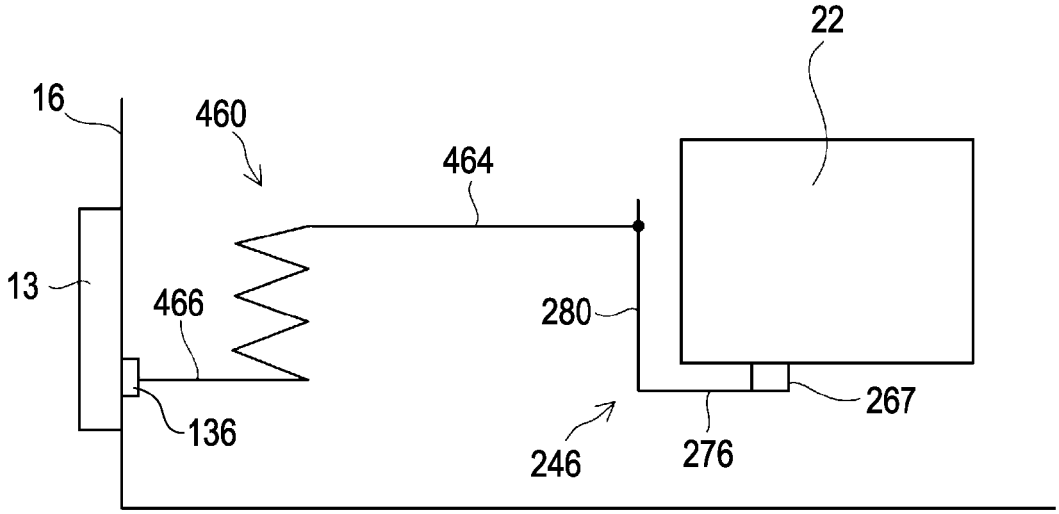
FIG. 2 is diagram schematically illustrating an inter-terminal connection mode according to the first embodiment.

FIG. 2 is diagram schematically illustrating the inter-terminal connection mode according to the first embodiment. FIG. 2 illustrates a connection mode in a state where the liquid storage container is assembled. A sensor terminal 267 provided in the liquid detecting unit 22 is in contact with a sensor terminal contact portion 276 of the sensor-side connection member 246. On the other hand, a first arm portion 466 of the board-side connection member 460 is in contact with a board terminal 136 provided in the circuit board 13. In addition, a second arm portion 464 of the board-side connection member 460 is in contact with a member contact portion 280 of the sensor-side connection member 246. Accordingly, the board terminal 136 and the sensor terminal 267 which are separated from each other are electrically connected.

Returning to FIG. 1, description of the ink cartridge 10 is continued. The board-side connection member 460 is a torsion coil spring having conductivity. The board-side connection member 460 has the first arm portion 466, a coil portion 462, and the second arm portion 464. The first arm portion 466 is in contact with the board terminal 136 (FIG. 2) of the circuit board 13 mounted on the second case 16. The second arm portion 464 is in contact with the sensor-side connection member 246 which is in contact with the sensor terminal 267. One ends of the first and second arm portions 466 and 464 have bent portions 466*a* and 464*a* which are bent. In addition, a specific mode of contact between the board-side connection member 460 and the sensor-side connection member 246 will be described in detail later. Here, the "first connection member" described in summary corresponds to the "sensor-side connection member 246", and the "second connection member" corresponds to the "board-side connection member 460".

The ink pack 14 includes a liquid storage unit 18 for storing ink therein and a liquid supply unit 20 for supplying ink in the liquid storage unit 18 into the printer. The liquid storage unit 18 is a bag body which is formed of an aluminum-laminated multilayer film by laminating an aluminum layer on a resin film layer and thus has flexibility.

One end of the liquid supply unit 20 is connected to the liquid storage unit 18. In addition, the other end side of the liquid supply unit 20 is provided with an open hole 303 which is open to the outside. The liquid supply unit 20 includes the liquid detecting unit 22 used for detecting the amount of the ink (hereinafter, also called a "residual amount of ink") stored in the ink pack 14 and a liquid discharge passage (not shown) for supplying the ink in the ink pack 14 into the printer. In addition, the sensor-side connection member 246 connected to the sensor terminal 267 (FIG. 2) provided in the liquid detecting unit 22 is mounted on the liquid supply unit 20.

The first and second cases 12 and 16 have rectangular outer shapes and are each molded as one body from a synthetic resin such as polyethylene. The second case 16 has first to fifth faces 16*a* to 16*e* and an opening portion 16*f* which is open as a side. The first face 16*a* is a face opposed to the opening portion 16*f*. The second face 16*b* is a face provided with an insertion opening 34 through which an ink supplying needle (liquid supplying needle) of the printer is inserted, from among the four faces perpendicular to the first face 16*a*. The third face 16*c* is a face opposed to the second face 16*b*. The fourth face 16*d* is a face which is perpendicular to the first to third faces 16*a* to 16*c* on which the circuit board 13 is mounted. The fifth face 16*e* is a face opposed to the fourth face 16*d*. Here, for the convenience of description, the first, second, third, fourth, and fifth faces 16*a*, 16*b*, 16*c*, 16*d*, and 16*e* are respectively called a bottom face 16*a*, a front face 16*b*, a rear face 16*c*, a right face 16*d*, and a left face 16*e*. In addition, a direction perpendicular to the right and left faces 16*d* and 16*e* (X-axis direction) is referred to as the width direction, a direction perpendicular to the front and rear faces 16*b* and 16*c* (Y-axis direction) is referred to as the length direction, and a direction perpendicular to the bottom face 16*a* and the opening portion 16*f* (Z-axis direction) is referred to as the thickness direction.

The width of the second case 16 is substantially the same as that of the liquid storage unit 18. Accordingly, rattling (shaking) of the ink pack 14 in the width direction in the first and second cases 12 and 14 (hereinafter, simply called "cases 12 and 14") which occur during transportation of the ink cartridge 10 or the like is suppressed. In addition, the bottom face 16*a* of the second case 16 has inclined portions 17 on the front face 16*b* side and the rear face 16*c* side. Similarly, the first case 12 has inclined portions (not shown). The inclined portions 17 of the first and second cases 12 and 16 have shapes following the inclined portions 18*a* and 18*b* of the ink pack 14. Accordingly, the rattling of the ink pack in the thickness direction in the cases which occurs during transportation of the ink cartridge 10 is suppressed. Moreover, rattling of the ink pack 14 in the length direction in the cases 12 and 14 during transportation of the ink cartridge 10 is suppressed as the liquid supply unit 20 is held by a supply unit positioning portion 34*a* which is formed as a compartment in the second case 16. Moreover, as the liquid supply unit 20 is held by the supply unit positioning portion 34*a*, the position of the ink pack 14 is determined in the second case 16.

The front face 16*b* of the second case 16 is provided with two positioning holes 30 and 32 as well as the insertion opening 34. Positioning pins provided in the printer are inserted through the positioning holes 30 and 32 when the ink cartridge 10 is mounted on the printer. Accordingly, the mounting position of the ink cartridge 10 in the printer is determined.

The circuit board 13 is mounted on the right face 16*d* on the front face 16*b* side. The circuit board 13 has a plurality of terminals 130 disposed on the surface (the face facing the outer side of the second case 16). In addition, the circuit board 13 has a memory device disposed on the rear surface and the board terminal 136 (FIG. 2) conductively connected with a part of the terminal on the surface. When the ink cartridge 10 is mounted on the printer, the terminals 130 come in contact with a terminal of a control unit side of the printer. The board terminal 136 of the circuit board 13 is in contact with the first arm portion 466 via a hole (not shown) provided in the right face 16*d*. Accordingly, as the printer controls the liquid detecting unit 22 (specifically, a sensor portion described later) or analyzes a signal output from the sensor portion, the residual amount of ink of the ink cartridge 10 can be detected. Moreover, the ink cartridge 10 is mounted on the printer so that the X-axis positive direction illustrated in FIG. 1 goes downward and the X-axis negative direction goes upward.

A-2. Configuration of Liquid Supply Unit 20

Before describing the configuration of the liquid supply unit 20 in detail, for ease of understanding, the configuration of a main ink passage included in the liquid supply unit 20 and the flow of the ink which occurs when the ink is supplied to the printer will be described with reference to FIG. 3.

Figure 3:
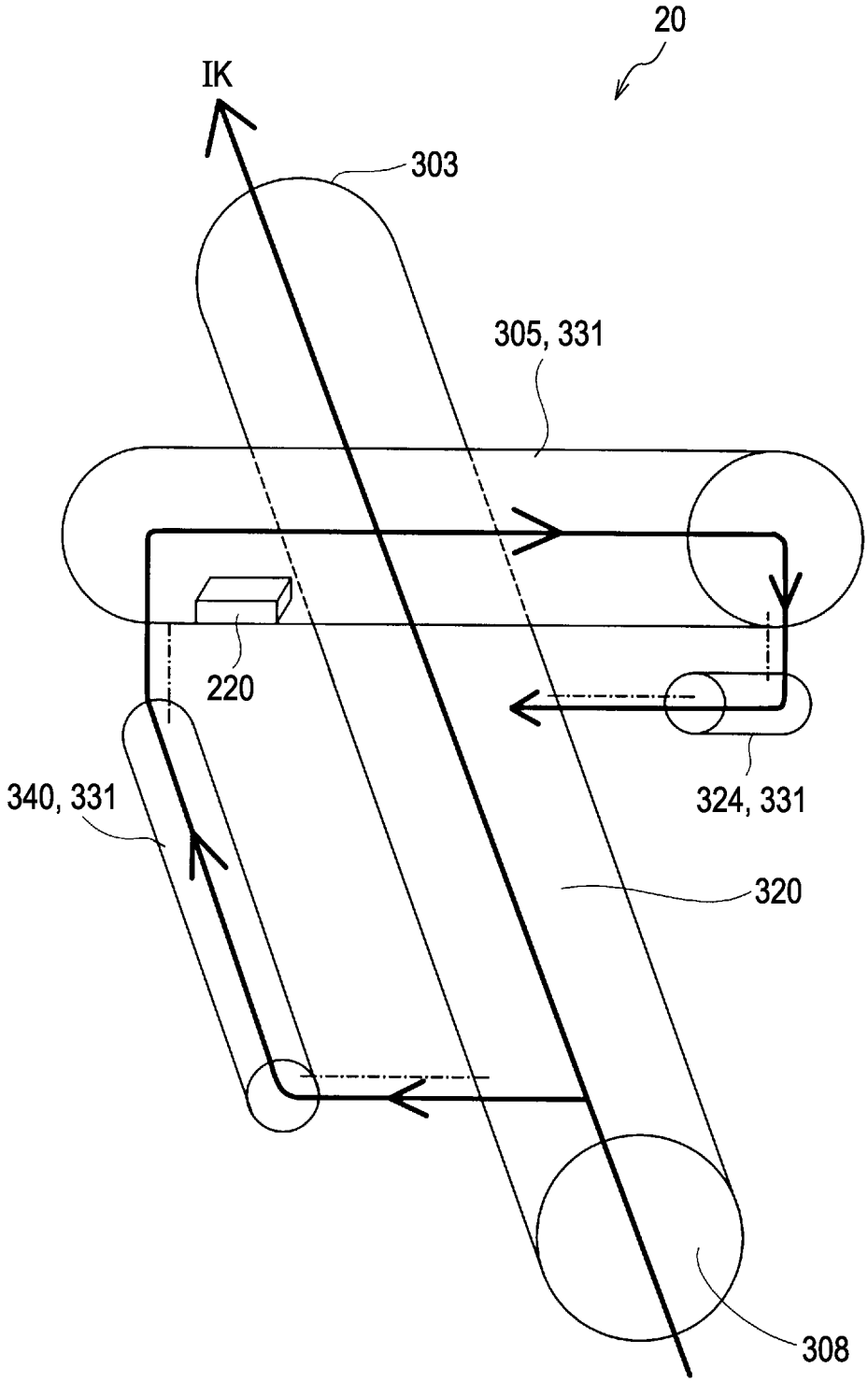
FIG. 3 is a diagram schematically illustrating an ink passage included in a liquid supply unit.

FIG. 3 is a diagram schematically an ink passage included in the liquid supply unit 20. The directions of arrows shown in FIG. 3 represent directions of the flow of an ink that occurs when the ink IK is supplied to the printer. In addition, a dot-dashed line shown in FIG. 3 represents that the passages are connected.

The liquid supply unit 20 includes a liquid discharge passage 320 and a liquid detection passage 331. The liquid detection passage 331 has an upstream-side communication passage 340, a liquid detection chamber 305, and a downstream-side communication passage 324. In addition, a sensor unit 220 used for detecting the residual amount of ink is disposed in the liquid detection chamber 305. First, the flow of the ink of the liquid detection passage 331 that occurs when the ink is supplied to the printer will be described. A part of the ink flowing into the liquid discharge passage 320 from the liquid storage unit 18 (FIG. 1) via a first opening portion 308 diverges from the ink and flows into the upstream-side communication passage 340. The ink flowing into the upstream-side communication passage 340 passes through the liquid detection chamber 305 and the downstream-side communication passage 324 in this order and starts flowing into the liquid discharge passage 320. The ink starts flowing from the downstream-side communication passage 324 to the liquid discharge passage 320 and is supplied to the printer through the open hole 303. That is, the liquid detection passage 331 is provided with the liquid detection chamber 305 partway along and thus is a passage for supplying the ink in the liquid storage unit 18 into the printer through the liquid detection chamber 305. On the other hand, the liquid discharge passage 320 is a passage for directly supplying the ink in the liquid storage unit 18 into the printer without passing through the liquid detection chamber 305.

Figure 4:
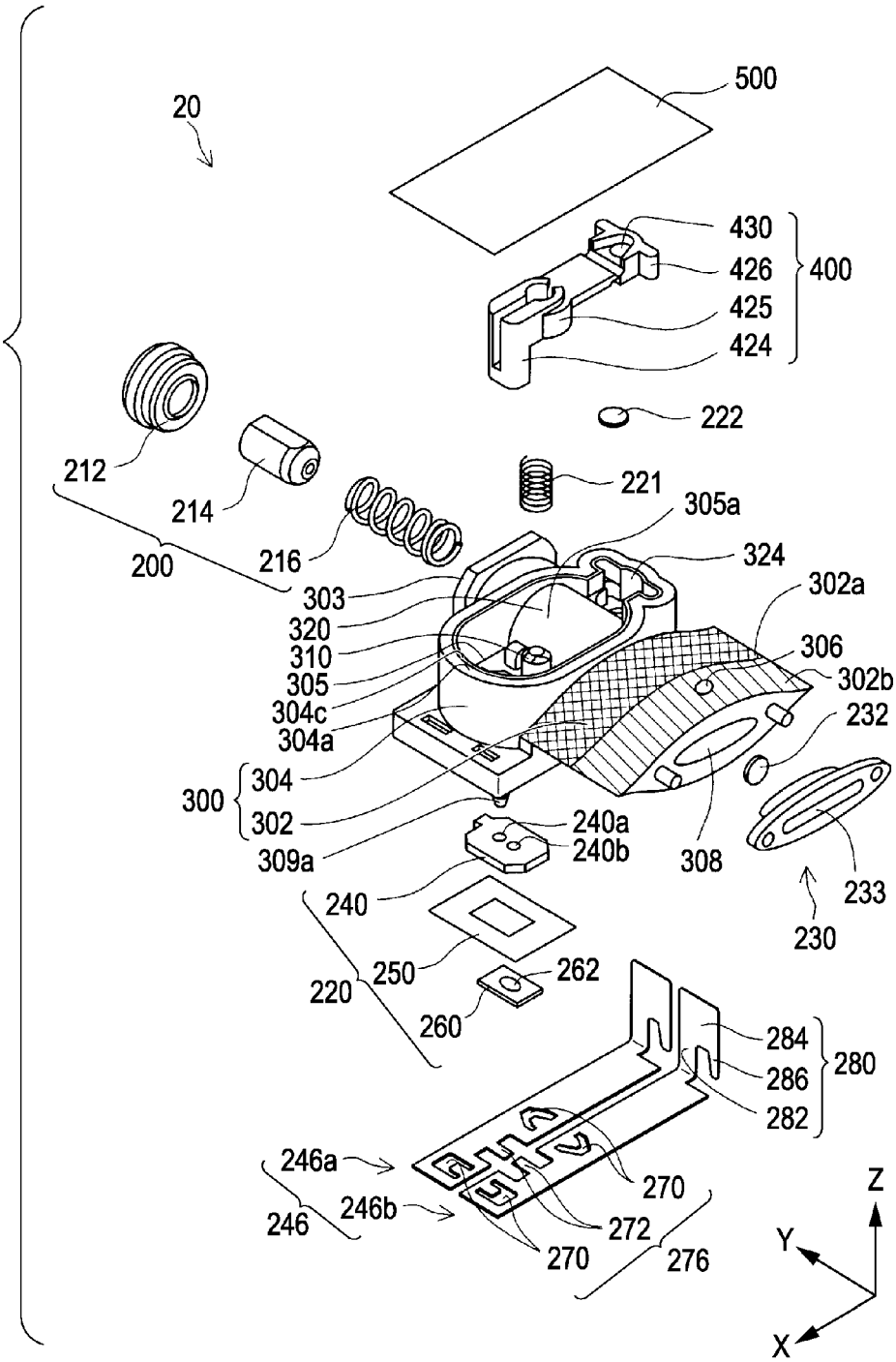
FIG. 4 is an exploded perspective view of the liquid supply unit.

FIG. 4 is an exploded perspective view of the liquid supply unit 20. The liquid supply unit 20 includes a supply unit main body 300, a valve mounting portion 230, a sensor unit 220, a seal unit 200, a movement member 400, a spring 221, a flexible film 500, the sensor-side connection member 246, and two valve bodies 222 and 232. Here, the supply unit main body 300 (specifically, the liquid detection chamber 305 described later), the movement member 400, the flexible film 500, the spring 221, and the sensor unit 220 constitute the liquid detecting unit 22 (FIG. 1) used for detecting the amount of ink stored in the ink pack 14.

The supply unit main body 300 is molded as one body from a synthetic resin such as polyethylene. The supply unit main body 300 is provided with passages (for example, the liquid discharge passage 320 and the liquid detection chamber 305) through which the ink flowing into the liquid storage unit 18 (FIG. 1) flows. In addition, the supply unit 300 has a first main body portion 302 to which the liquid storage unit 18 is welded, and a second main body portion 304 provided with the liquid detection chamber 305. Moreover, for the convenience of description, hereinafter, a side positioned in the Z-axis positive direction with respect to the liquid detection chamber 305 is referred to a top surface, and a side positioned in the Z-axis negative direction is referred to as a bottom surface.

The first main body portion 302 is provided with a first opening portion 308 and a second opening portion 306. The valve mounting portion 230 which functions as a valve seat and the valve body 232 are mounted on the first opening portion 308. In addition, the ink stored in the liquid storage unit 18 flows into the first opening portion 308 via an opening portion 233 of the valve mounting portion 230. The second opening portion 306 is communicated with a downstream side part of the liquid discharge passage 320 with respect to a part where the valve body 232 is disposed. Moreover, in the specification, the "upstream side" and the "downstream side" are based on a direction of flow of the ink when the ink is supplied from the ink pack 14 to the printer.

As the valve body 232 is seated on the valve seat of the valve mounting portion 230, the flow of the ink from the supply unit main body 300 to the liquid storage unit 18 is suppressed. Accordingly, incorporation of bubbles into the liquid storage unit 18 along with the ink can be suppressed, thereby preventing deterioration of the ink.

In order to fill the ink in the liquid storage unit 18, the liquid storage unit 18 is welded to an external surface part 302*a* which is cross-hatched and positioned on the open hole 303 side from the second opening portion 306 in an external surface part of the first main body portion 302. Next, the ink is injected into the liquid discharge passage 320 from the open hole 303. Then, the ink starts flowing from the second opening portion 306 communicated with the liquid discharge passage 320 such that the ink is filled in the liquid storage unit 18. After the ink is filled in the liquid storage unit 18, the liquid storage unit 18 is welded to an external surface part 302*b* which is single-hatched and includes the second opening portion 306 in the external surface of the first main body portion 302. Accordingly, the second opening portion 306 is blocked by the liquid storage unit 18. Therefore, although a check valve mechanism (the valve body 232 and the valve mounting portion 230) for suppressing ink backflow toward the liquid discharge passage 320 is provided, the ink can be filled in the liquid storage unit 18.

The seal unit 200 has a seal member 212, and a valve member 214, and a compression coil spring 216, and the members 212, 214, and 216 are sequentially disposed in this order inside the liquid discharge passage 320 starting from the open hole 303. In a case where the ink cartridge 10 is not mounted on the printer, the liquid discharge passage 320 is blocked by the seal unit 200 to prevent the ink from flowing through the open hole 303.

The second main body portion 304 is mainly provided with a part of the liquid discharge passage 320 and the liquid detection chamber 305. The liquid detection chamber 305 is a region surrounded by the second main body portion 304. In the liquid detection chamber 305, various members used for detecting the amount of liquid remaining in the ink pack 14 described later are disposed.

The top surface of the liquid detection chamber 305 has an opening portion 305*a*. In addition, the bottom surface of the liquid detection chamber 305 is provided with a sensor disposition opening portion (not shown) for disposing a sensor base 240 described later. The sensor disposition opening portion is formed to penetrate the bottom surface member of the second main body portion 304. In addition, in the liquid detection chamber 305, the spring 221, the movement member 400, and the sensor unit 220 are disposed. Moreover, a flexible film 500 is adhered to a protruding portion 304*c* provided on an inner side of a peripheral end side 304*a* of the second main body portion 304 so as to block the opening portion 305*a* of the liquid detection chamber 305.

The movement member 400 has a seal portion 424, a spring holding portion 425, and an abutting portion 426. The seal portion 424 is a member extending in the depth direction of the liquid detection chamber 305 and is able to abut the sensor unit 220 via the sensor disposition opening portion. The spring holding portion 425 is a member having a substantially cylindrical shape and holds the upper end side of the spring 221 with its inner peripheral surface. The abutting portion 426 is press-fitted to the liquid detection chamber 305. In addition, the abutting portion 426 is provided with a though-hole 430 for communicating the liquid detection chamber 305 with the downstream-side communication passage 324 connected to the liquid discharge passage 320. The valve body 222 is provided in the downstream-side communication passage 324. As the valve body 222 is seated on the abutting portion 426, the flow of the ink from the liquid discharge passage 320 toward the liquid detection chamber 305 via the downstream-side communication passage 324 is suppressed. That is, the valve body 222 is seated on the abutting portion 426 of the movement member 400 and thus blocks the through-hole 430.

The spring 221 is held by a spring holding portion 310 protruding from the bottom surface toward the top surface of the liquid detection chamber 305 and the spring holding portion 425 of the movement member 400 so as to bias the sensor unit 220 and the seal portion 424 in a direction increasing the distance therebetween. That is, the spring 221 biases the two in a direction increasing the volume of the liquid detection chamber 305.

Figure 5:
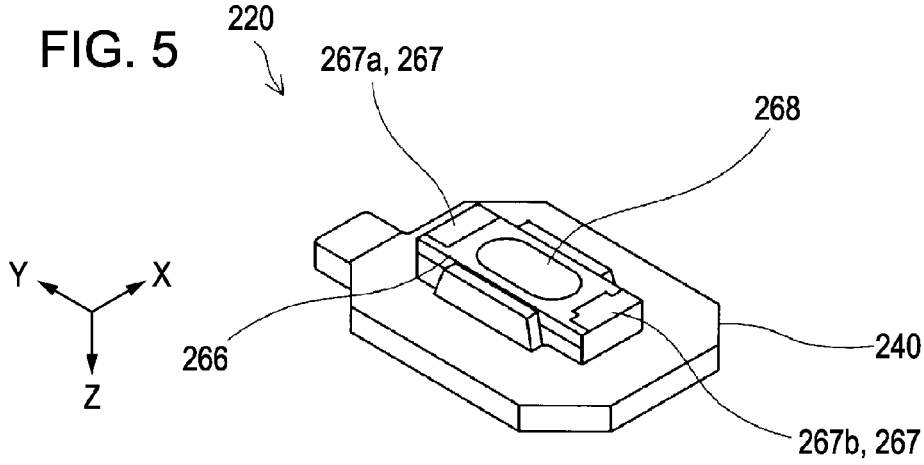
FIG. 5 is a diagram of a sensor unit of FIG. 4 as viewed from a Z-axis negative direction.

Next, the sensor unit 220 will be described with reference to FIGS. 4 and 5. FIG. 5 is a diagram of the sensor unit 220 of FIG. 4 as viewed from the Z-axis negative direction. Moreover, illustration of a film 250 is omitted in FIG. 5.

As illustrated in FIG. 4, the sensor unit 220 has a sensor base 240 made of a metal (stainless steel), a film 250 made of resin, a sensor portion 260 mounted on a surface on a side (rear surface) of the sensor base 240. The sensor base 240 is accommodated into the sensor disposition opening portion. The sensor base 240 is mounted on the liquid detection chamber 305 as the peripheral edge of the sensor disposition opening portion and the sensor base 240 are coated with the film 250. Moreover, the center portion of the film 250 is provided with an opening which is slightly greater than the outer shape of the sensor portion 260, and the sensor portion 260 is disposed inside the opening so as to be fixed to the sensor base 240. The sensor base 240 is provided with two through-holes 240*a* and 240*b* which penetrate in the thickness direction (Z-axis up and down direction).

As illustrated in FIGS. 4 and 5, the sensor portion 260 includes a sensor cavity (also called a "communication passage") 262 through which the ink in the liquid detection chamber 305 flow in and flow out, a vibration plate 266, a piezoelectric element 268, and two sensor terminals 267*a* and 267*b*. Moreover, in the specification, in a case where there is no need to distinguish between the two sensor terminals 267*a* and 267*b*, they are simply called a sensor terminal 267.

When a drive signal generated by the control unit of the printer is applied to the sensor terminal 267 from the board terminal 136 (FIG. 2), after the piezoelectric element 268 is excited for a predetermined time as an actuator, the vibration plate 266 starts free vibration. Due to the free vibration of the vibration plate 266, a counter-electromotive force occurs in the piezoelectric element 268, and a waveform representing the counter-electromotive force is output as a detection signal (also called a "waveform signal") to the control unit of the printer via the circuit board 13 from the sensor terminal 267.

Here, the waveform signal state (amplitude or frequency) is changed as a communication state of the sensor cavity 262 and the liquid detection chamber 305 changes in response to a change in ink pressure in the liquid detection chamber 305. For example, when the movement member 400 abuts the sensor base 240 and thus the sensor cavity 262 and the liquid detection chamber 305 are not communicated with each other, even though the drive signal is applied to the sensor terminal 267, the vibration plate 266 hardly vibrates, and a straight waveform without a variation is output as the detection signal. On the other hand, when the movement member 400 is separated from the sensor base 240 and thus the sensor cavity 262 and the liquid detection chamber 305 are communicated with each other, when the drive signal is applied to the sensor terminal 267, the vibration plate 266 vibrates, and a waveform with variations is output as the detection signal. That is, on the basis of the ink state in the sensor cavity 262 (whether or not ink in the sensor cavity 262 is communicated with the ink in the liquid detection chamber 305), the sensor unit 260 changes an output state of the detection signal.

Next, the sensor-side connection member 246 will be described in detail with reference to FIG. 4. The sensor-side connection member 246 is a member having conductivity. The sensor-side connection member 246 has a sensor terminal contact portion 276 having a plate shape and a member contact portion 280 which is bent at a right angle from the sensor terminal contact portion 276. The sensor terminal contact portion 276 is provided with four mounting holes 270. Using the mounting holes 270, the sensor-side connection member 246 is press-fitted to four bosses 309*a* (only one is illustrated in FIG. 4) provided in the second main body portion 304, thereby mounting the sensor-side connection member 246 to the supply unit main body 300. In addition, the sensor terminal contact portion 276 is provided with a contact piece 272. The contact piece 272 is in contact with the sensor terminal 267 (FIG. 5). Moreover, in a state where the ink pack 14 is stored in the second case 16, the sensor terminal contact portion 276 is parallel to the bottom face 16*a* of the second case 16.

The member contact portion 280 has a side portion 282, an upper portion 284, and a folded-back portion 286. In the state where the ink pack 14 is stored in the second case 16, the side portion 282 extends from one end of the sensor terminal contact portion 276 in a direction away from the bottom face 16*a* (that is, the Z-axis positive direction). The upper portion 284 extends from the side portion 282 in a direction which is parallel to the bottom face 16*a* and parallel to the left face 16*d* (that is, the Y-axis negative direction). That is, the member contact portion 280 forms a key shape with the side portion 282 and the upper portion 284. In addition, the folded-back portion 286 extends from the upper portion 284 in a direction approaching the bottom face 16*a* (that is, the Z-axis negative direction).

A-3. Detailed Configuration of Second Case 16 and Circuit Board 13

Figure 6A:
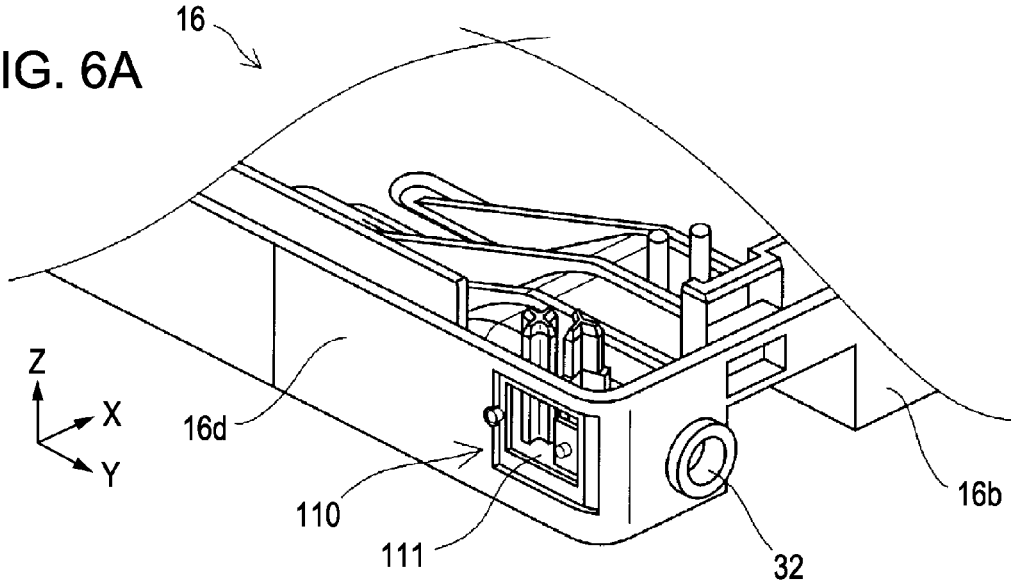
FIGS. 6A and 6B are diagrams illustrating a second case and a circuit board.
Figure 6B:
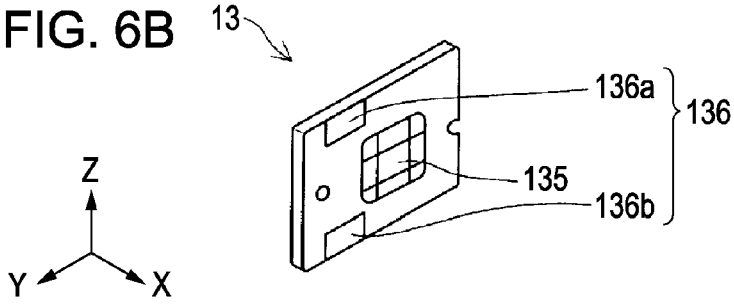

FIGS. 6A and 6B are diagrams illustrating the second case 16 and the circuit board 13. FIG. 6A is a partial perspective view of the second case 16, and FIG. 6B is a perspective view illustrating the rear surface side of the circuit board 13. As illustrated in FIG. 6A, a board mounting portion 110 for mounting the circuit board 13 is provided on the front face 16*b* side of the right face 16*d*. In a case where a through-hole 111 is provided in the center portion of the board mounting portion 110 and the circuit board 13 is mounted on the board mounting portion 110, a part of the rear surface of the circuit board 13 is exposed to the inside of the ink cartridge 10.

As illustrated in FIG. 6B, a memory device 135 and two board terminals 136*a* and 136*b* are disposed on the rear surface of the circuit board 13. The two board terminals 136*a* and 136*b* are conductively connected with a sensor driving terminal for outputting the drive signal to the piezoelectric element 268 from the printer from among the terminals 130 disposed on the surface (FIG. 1). Moreover, in the specification, in a case where there is no need to distinguish between the two board terminals 136*a* and 136*b* in use, they are simply called the board terminal 136.

Figure 7:
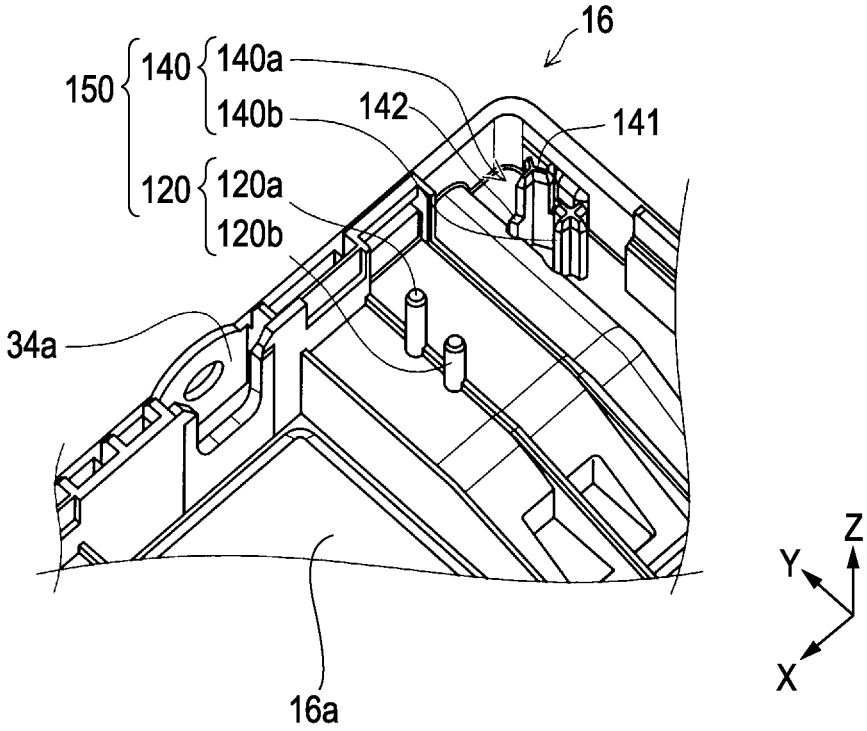
FIG. 7 is a partial perspective view of the second case.

FIG. 7 is a partial perspective view of the second case 16. The second case 16 has a positioning member 150. The positioning member 150 has two first protruding portions 140*a* and 140*b* and two second protruding portions 120*a* and 120*b*. Moreover, in the specification, in a case where there is no need to distinguish between the first protruding portions 140*a* and 140*b*, they are simply called a first protruding portion 140. Similarly, in a case where there is no need to distinguish between the second protruding portions 120*a* and 120*b*, they are simply called a second protruding portion 120.

The coil portion 462 (FIG. 1) of the board-side connection member 460 is inserted into the first protruding portion 140. The second protruding portion 120 limits elastic deformation of the second arm portion 464 of the board-side connection member 460 and position the second arm portion 464 in the second case 16 before the ink pack 14 is stored. Moreover, the first protruding portion 140*a* has, as well as an inserted portion 141 that is inserted into the coil portion 462, a seat portion 142 positioned on the bottom face 16*a* side from the inserted portion 141. The seat portion 142 comes in contact with one end surface of the coil portion 462 so as to position the board-side connection member 460*a* in the second case 16 in the thickness direction (Z-axis direction).

A-4. Method of Assembling Ink Cartridge

Figure 8A:
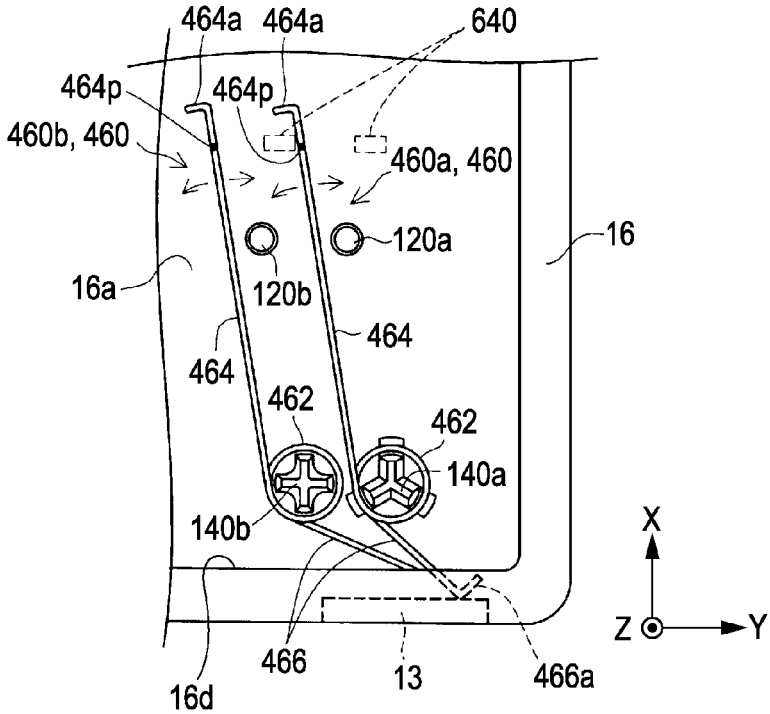
FIGS. 8A to 8C are diagrams illustrating a method of mounting a board-side connection member in the second case.
Figure 8B:
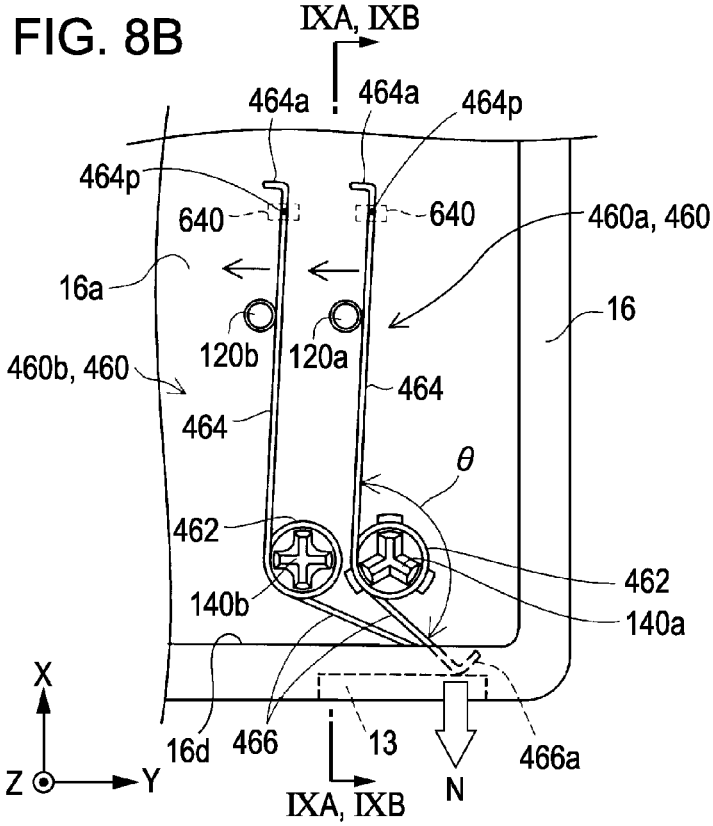
Figure 8C:
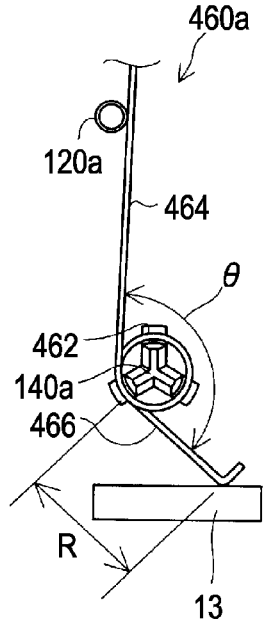

FIGS. 8A to 8C are diagrams illustrating a method of mounting the board-side connection member 460 in the second case 16. FIG. 8A is a first diagram of the second case 16 viewed in the Z-axis positive direction, FIG. 8B is a second diagram of the second case 16 viewed in the Z-axis positive direction. In addition, FIG. 8C is a diagram for explaining a load N of FIG. 8B and illustrates only the configuration needed for description of FIG. 8B.

As illustrated in FIG. 8A, in order to mount the board-side connection members 460*a* and 460*b* to the second case 16, first, the coil portions 462 are mounted so that the first protruding portions 140*a* and 140*b* are inserted therethrough. In addition, the first arm portion 466 is made to contact the board terminal 136 (FIG. 6B) of the circuit board 13. In FIG. 8A, a state where the first arm portion 466 of the board-side connection member 460*a* is in contact with the board terminal 136*a* of the circuit board 13 is illustrated by dashed lines. Moreover, although not shown in the figure, the first arm portion 466 of the board-side connection member 460*b* is in contact with the board terminal 136*b* (FIG. 6B) of the circuit board 13.

As illustrated in FIG. 8A, in the state where the coil portion 462 of the board-side connection member 460 is inserted and elastic deformation thereof is not limited by the second protruding portions 120*a* and 120*b*, by exerting an external force on the second arm portion 464, the second arm portion 464 is elastically deformed on a first plane which is parallel to the bottom face 16*a* as illustrated by arrow directions of FIG. 8A.

In order to store the ink pack 14 in the second case 16, the ink pack 14 is moved in a direction perpendicular to the bottom face 16*a* (Z-axis direction, hereinafter, also called the "vertical direction"). Specifically, the ink pack 14 is moved in the vertical direction so that a predetermined part of the liquid supply unit 20 is inserted into the supply unit positioning portion 34*a* (FIGS. 1 and 7). Here, the upper portion 284 (FIG. 4) of the member contact portion 280 is stored in the second case 16 through the first region 640 of the first plane. Moreover, the "movement in the direction perpendicular to the bottom face 16*a*" means that the movement may have at least a component of the direction.

As illustrated in FIG. 8B, the coil portions 462 are mounted so that the first protruding portions 140*a* and 140*b* are inserted therethrough and the second arm portions 464 come in contact with the board terminals 136, and thereafter an external force is exerted to the second arm portions 464 so that the second arm portions 464 are deformed and hooked on the second protruding portions 120*a* and 120*b*. That is, though the second arm portions 464 try to elastically deform in the arrow directions of FIG. 8B so as to return to their no-load positions, the elastic deformation thereof on the first plane is limited by the second protruding portions 120*a* and 120*b*. Accordingly, a part 464*p* (also called a "first site 464*p*") of the second arm portion 464 is made to be positioned in the first region 640. The first site 464*p* is a site with which the member contact portion 280 (FIG. 4) comes in contact. Next, as the ink pack 14 is stored in the second case 16, the second arm portion 464 is made to contact the member contact portion 280 (FIG. 4). That is, the upper portion 284 (FIG. 4) of the member contact portion 280 passes through the first region 640, so that the second arm portion 464 comes in contact with the member contact portion 280. As such, after the ink pack 14 is stored in the second case 16, an additional operation of causing the second arm portion 464 and the member contact portion 280 to come in contact with each other is not needed, so that assembly efficiency of the ink cartridge 10 can be enhanced.

In addition, by limiting the elastic deformation of the second arm portions 464 using the second protruding portions 120*a* and 120*b*, a relative angle θ between the both end portions (the first and second arm portions 466 and 464) of the board-side connection member 460 can be determined. Here, than the relative angle (also called a "free angle") of the board-side connection member 460 when there is no load, as the relative angle θ is reduced, a load N exerted by the first arm portion 466 on the board terminal 136 (FIG. 6) of the circuit board 13 is increased. That is, by causing the relative angle θ to be constant, variations of the load N can be reduced. In other words, by causing a relative positional relationship between the first and second protruding portions 140 and 120 and the board terminal 136 (FIG. 6) of the circuit board 13 to be constant, the relative angle θ can be made constant. Accordingly, even in a case where various types of ink cartridges which have different positional relationships between the sensor terminal 267 and the board terminal 136 are assembled, by causing the relative angle θ to be constant, failure of conduction between the sensor terminal 267 and the board terminal 136 can be reduced. Moreover, the load N in the figure represents a load of a component in the X-axis negative direction of the load exerted on the board terminal 136 by the first arm portion 466.

In addition, as illustrated in FIG. 8C, the load N is reduced as the distance (load exertion radius) R from the end portion of the coil portion 462 to a contact point of the first arm portion 466 and the circuit board 13 is increased. That is, when the second case 16 and the board-side connection member 460 (torsion coil spring) are designed, by causing the relative angle θ and the load exertion radius R to be constant, variations of the load N can further be reduced. In other words, when the distance between the first protruding portion 140 and the board terminal 136 is caused to be constant as well as the relative positional relationship between the first and second protruding portions 140 and 120 and the board terminal 136 (FIG. 6) of the circuit board 13, the load N can be made constant. The relative angle θ and the load exertion radius R may be made constant. Accordingly, failure of the conduction between the sensor terminal 267 and the board terminal 136 can further be reduced.

Figure 9A:
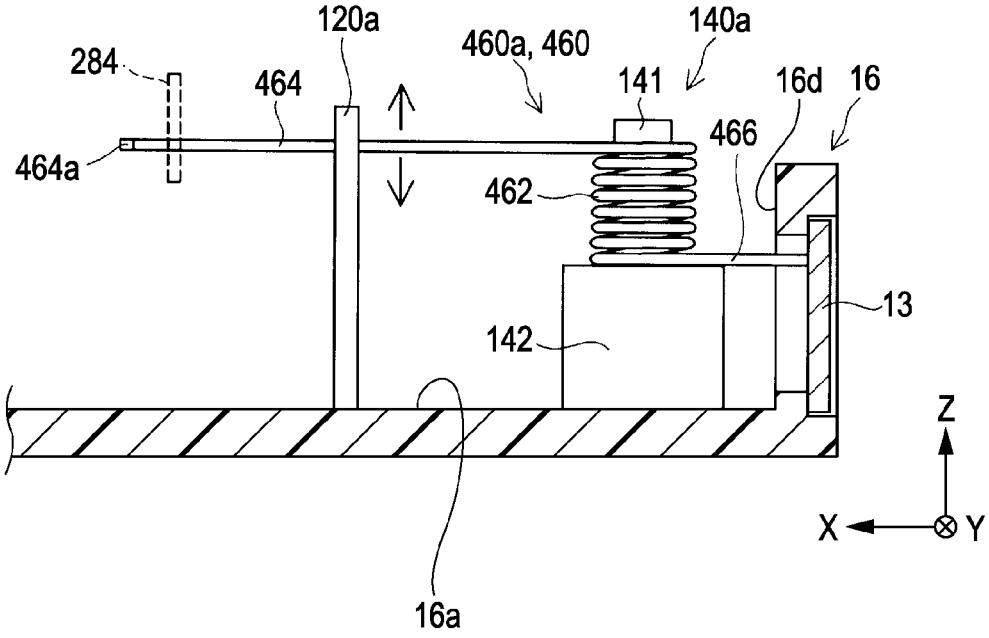
FIGS. 9A and 9B are diagrams illustrating a state where the board-side connection member is mounted.
Figure 9B:
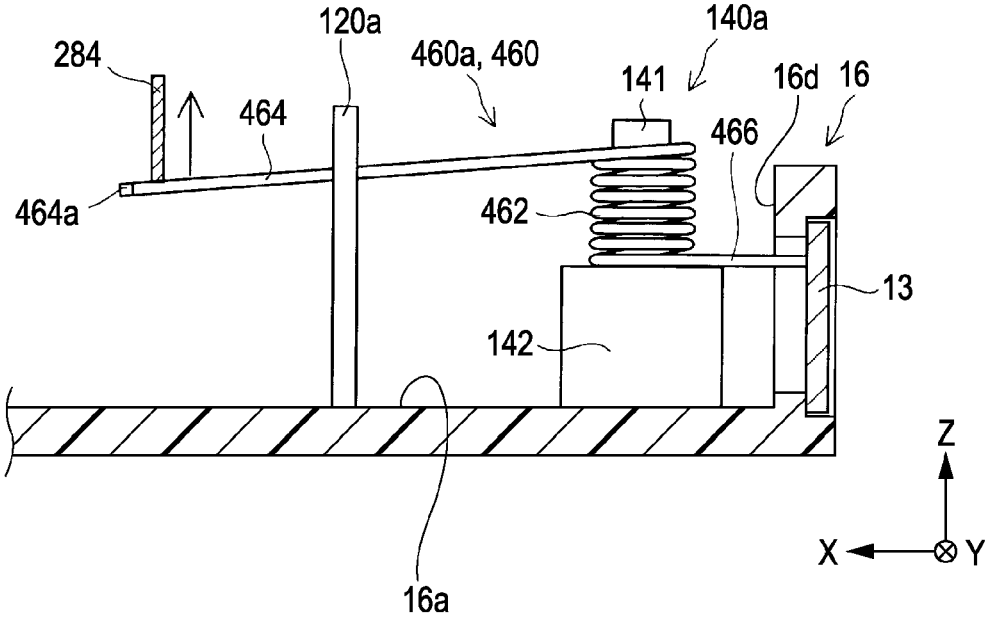

FIGS. 9A and 9B are diagrams illustrating a state where the board-side connection member 460 is mounted. FIG. 9A is a first diagram schematically illustrating a partial cross-section taken along the line IXA-IXA of FIG. 8B in a state where the ink pack 14 is not stored in the second case 16. FIG. 9B is a second diagram schematically illustrating the partial cross-section taken along the line IXB-IXB of FIG. 8B in a state where the ink pack 14 is stored in the second case 16 and the upper portion 284 (FIG. 4) of the sensor-side connection member 246 is in contact with the second arm portion 464. Moreover, in FIGS. 9A and 9B, only components needed for description are illustrated. Furthermore, here, description is provided using the board-side connection member 460*a*; however, the other board-side connection member 460*b* is in the same mounted state described as follows.

As illustrated in FIG. 9A, in the state where the elastic deformation on the first plane is limited by the second protruding portion 120*a*, the second arm portion 464 is able to elastically deform in the vertical direction as shown by arrow directions. Moreover, in the state where the ink pack 14 (FIG. 1) is stored in the second case 16, the upper portion 284 is positioned at a point overlapping with the second arm portion 464.

As illustrated in FIG. 9B, when the ink pack 14 is stored in the second case 16, the upper portion 284 comes in contact with the second arm portion 464 and the upper portion 284 presses the second arm portion 464 against the bottom face 16*a*. The second arm portion 464 is likely to elastically deform in the arrow directions so as to return to the shape when there is no load. However, the upper portion 284 limits the elastic deformation thereof in the vertical direction. Accordingly, the second arm portion 464 exerts a predetermined load on the upper portion 284, so that even when an impact is exerted on the ink cartridge 10 from the outside, a possibility that the upper portion 284 and the second arm portion 464 are separated from each other can be reduced. That is, the contact between the board-side connection member 460 and the sensor-side connection member 246 is properly maintained, so that failure of the conduction between the board terminal 136 and the sensor terminal 267 which are separated from each other can be reduced.

In addition, by the seat portion 142 of the first protruding portion 140*a*, the position of the board-side connection member 460*a* from the bottom face 16*a* of the second case 16 can be determined. Accordingly, the first arm portion 466 can be easily made to contact the board terminal 136*a* of the circuit board 13. Therefore, the assembly efficiency of the ink cartridge 10 can be enhanced.

Figure 10:
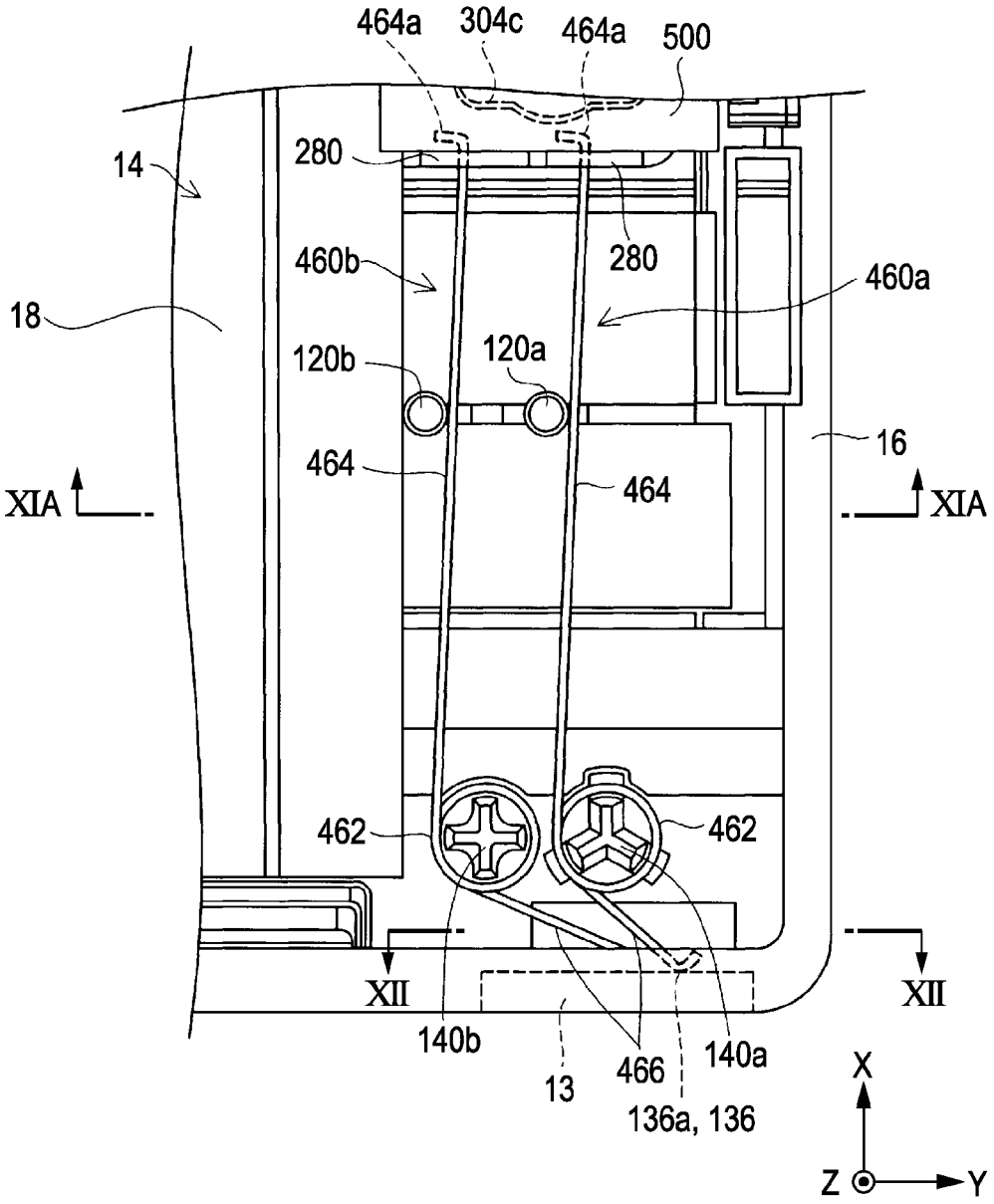
FIG. 10 is a diagram illustrating a state where the board-side connection members come in contact with other members.

FIG. 10 is a diagram illustrating a state where the board-side connection members 460*a* and 460*b* come in contact with other members. FIG. 10 is a diagram illustrating a part of the ink pack 14 stored in the second case 16 as viewed in the Z-axis positive direction.

In the state where the ink pack 14 is stored in the second case 16, since the member contact portion 280 is in contact with the second arm portion 464, the sensor terminal 267 (FIG. 5) and the board terminal 136 which are separated from each other are electrically connected via the board-side connection members 460*a* and 460*b* and the sensor-side connection member 246 (FIG. 4).

Figure 11A:
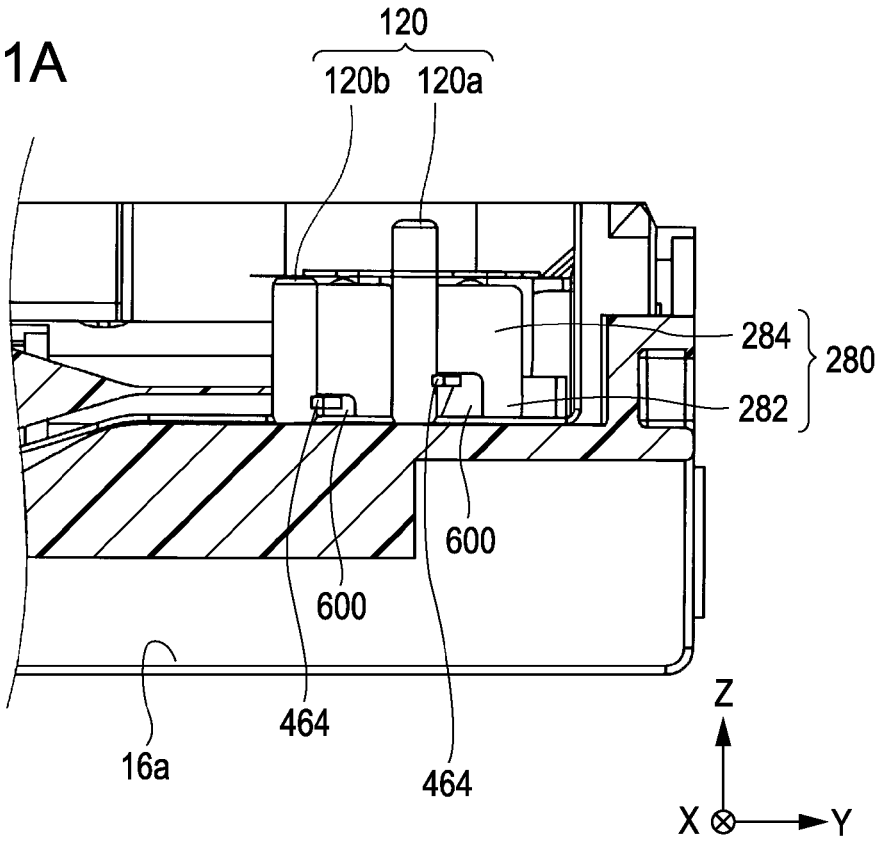
FIGS. 11A and 11B are diagrams illustrating a state where a second arm portion and a member contact portion are in contact with each other.
Figure 11B:
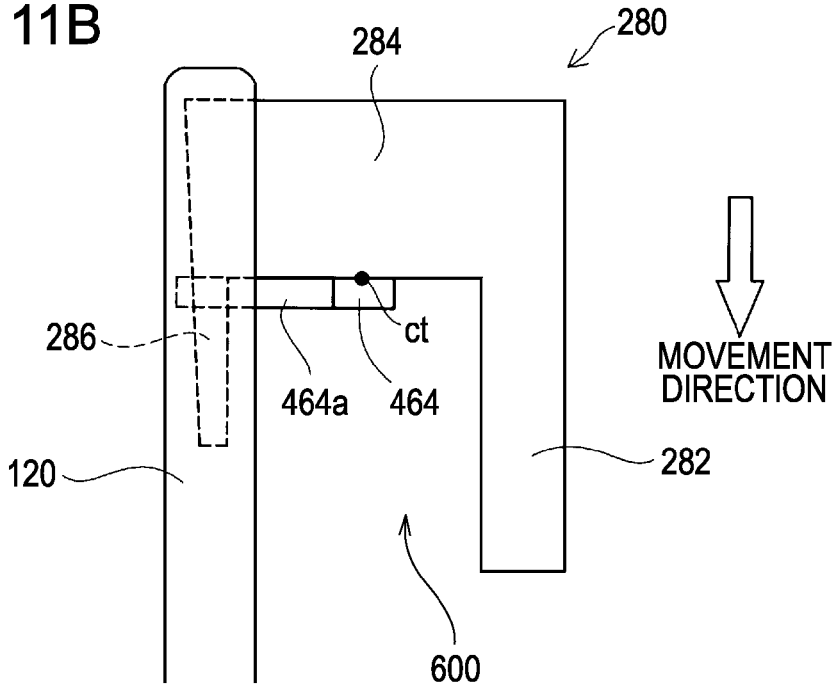

FIGS. 11A and 11B are diagrams illustrating a state where the second arm portion 464 and the member contact portion 280 are in contact with each other. FIG. 11A is a partial cross-sectional view taken along the line XIA-XIA of FIG. 10, and FIG. 11B is a diagram schematically illustrating only the main part of FIG. 11A. FIG. 11A is a diagram viewed along the second arm portion 464 in a direction approaching the member contact portion 280.

As illustrated in FIGS. 11A and 11B, a predetermined region 600 is formed by the second protruding portion 120 and the member contact portion 280. The predetermined region 600 is enclosed by the second protruding portion 120 and the member contact portion 280 in directions other than the movement direction (the direction from the opening portion 16*f* to the bottom face 16*a*) of the member contact portion 280 when the ink pack 14 is stored in the second case 16. In addition, in the predetermined region 600, a contact point ct of the second arm portion 464 and the member contact portion 280 is positioned.

As such, since the ink cartridge 10 has the predetermined region 600, even when an impact is exerted on the ink cartridge 10, a change in position of the second arm portion 464 with respect to the member contact portion 280 can be limited to a predetermined range. In other words, even when an impact is exerted on the ink cartridge 10, since the predetermined region 600 is formed, the second arm portion 464 moves within the range so as to maintain the contact with the member contact portion 280. Therefore, the contact between the member contact portion 280 and the second arm portion 464 can be properly maintained, thereby reducing failure of the conduction between the board terminal 136 and the sensor terminal 267.

In addition, as illustrated in FIGS. 10 and 11B, in the state where the ink cartridge 10 is stored in the second case 16, a part of the bent portion 464*a* of the second arm portion 464 overlaps with the member contact portion 280 (specifically, the folded-back portion 286). Accordingly, an impact is exerted on the ink cartridge 10 from the outside, and even when the position of the second arm portion 464 temporarily changes with respect to the member contact portion 280, the bent portion 464*a* is caught on the member contact portion 280, thereby easily maintaining the contact state. Accordingly, failure of the conduction between the board terminal 136 and the sensor terminal 267 can be further reduced.

Figure 12:
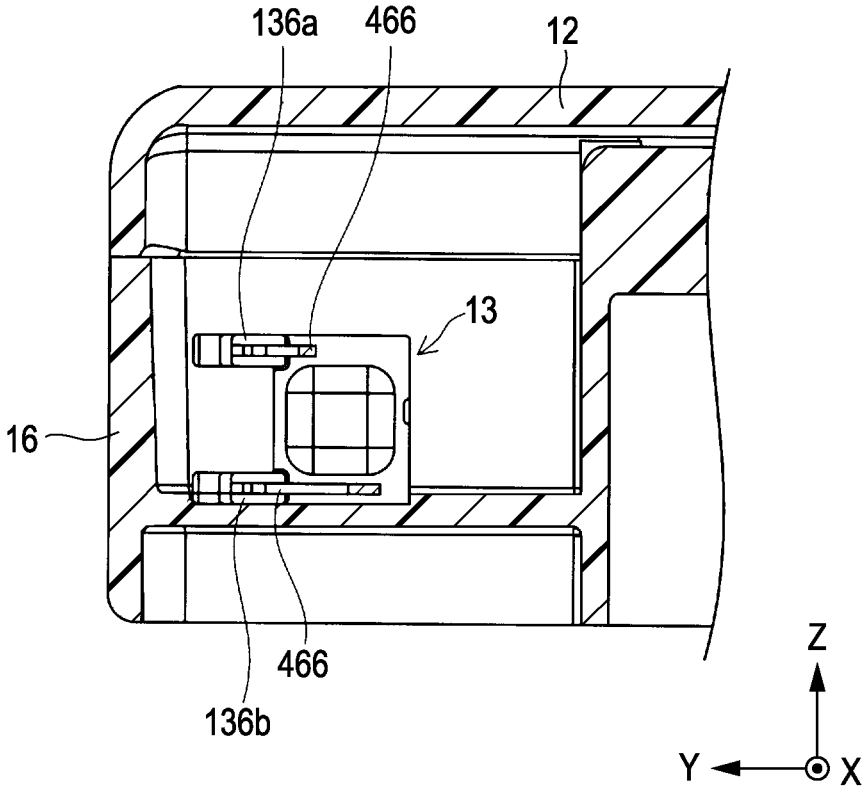
FIG. 12 is a partial cross-sectional view taken along the line XII-XII of FIG. 10.

FIG. 12 is a partial cross-sectional view taken along the line XII-XII of FIG. 10. In the state where the ink pack 14 is stored in the second case 16, the two first arm portions 466 come in contact with the board terminals 136*a* and 136*b* of the circuit board 13 at different positions.

As described above, according to the first embodiment, the second case 16 is provided with the second protruding portion 120 for determining the position of the first site 464*p* of the second arm portion 464 (FIGS. 7 to 8B), so that the second arm portion 464 and the member contact portion 280 are easily made to contact each other. Therefore, the assembly efficiency of the ink cartridge 10 can be enhanced. In addition, since the liquid supply unit 20 itself has the liquid detecting unit 22 used for detecting the residual amount of ink (FIG. 1), an operation of connecting the liquid supply unit 20 and the liquid detecting unit 22 is not needed. Accordingly, the assembly efficiency of the ink cartridge can further be enhanced than that of an ink cartridge which is manufactured as an additional member to detach the liquid supply unit 20 and the liquid detecting unit 22 from each other.

B. Second Embodiment

Figure 13A:
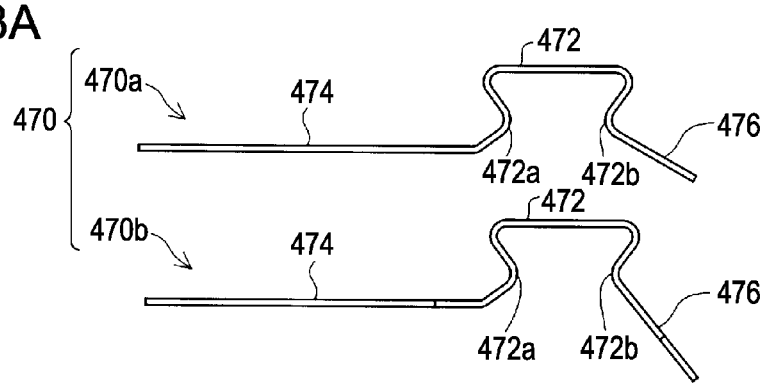
FIGS. 13A to 13C are diagrams illustrating an ink cartridge according to a second embodiment.
Figure 13B:
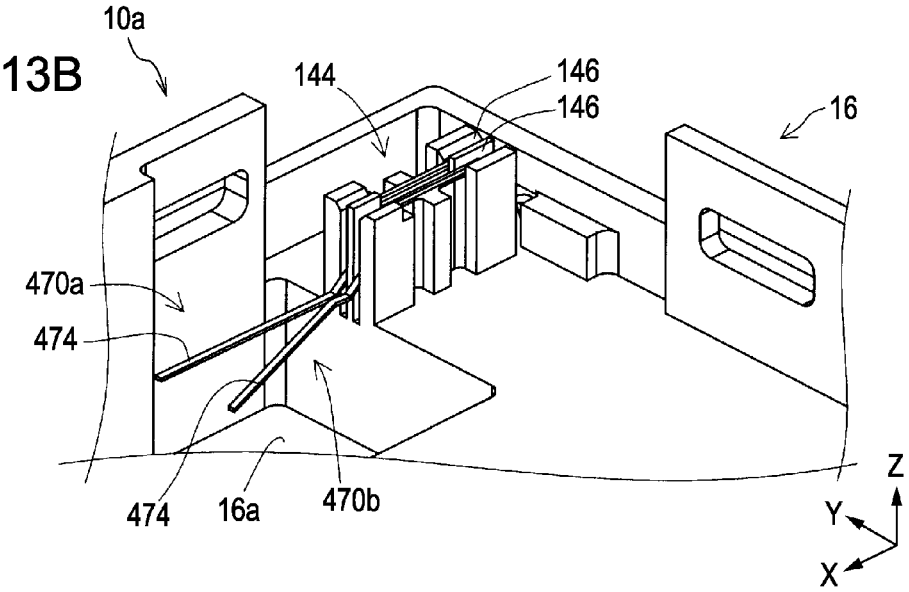
Figure 13C:
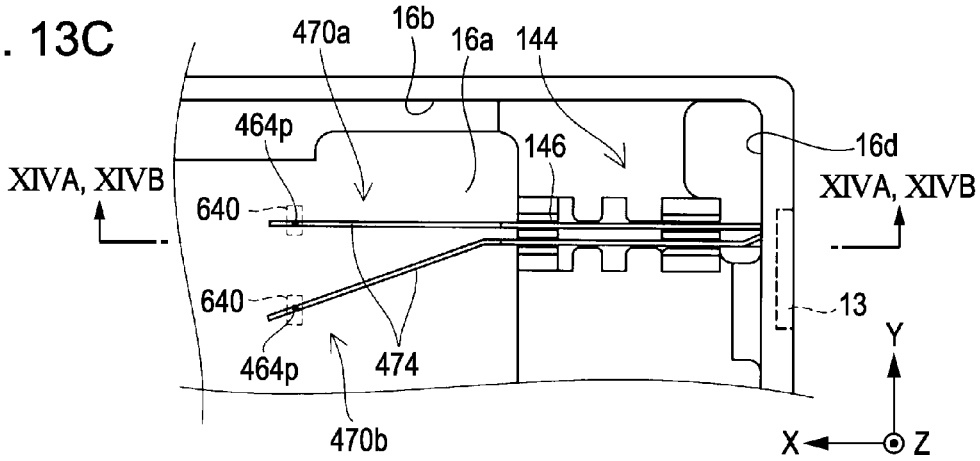

FIGS. 13A to 13C are diagrams illustrating an ink cartridge 10*a* according to a second embodiment. FIG. 13A is a diagram illustrating a board-side connection member 470. FIG. 13B is a partial perspective view of the second case 16. FIG. 13C is a diagram of FIG. 13B as viewed in the Z-axis positive direction. The ink cartridge 10*a* is different from the ink cartridge 10 according to the first embodiment in the configurations of the board-side connection member and a positioning member. Other configurations (the ink pack 14, the first case 12, and the like) are the same as those of the first embodiment, so that description of the same configurations will be omitted.

As illustrated in FIGS. 13A to 13C, the two board-side connection members 470*a* and 470*b* according to the second embodiment are wire worked springs having conductivity. Moreover, in the specification, in a case where there is no need to distinguish between the two board-side connection members 470*a* and 470*b*, they are simply called a board-side connection member 470. As illustrated in FIG. 13A, the board-side connection member 470 has an elastic portion 472 which is extensible in a predetermined direction (a direction in which the board-side connection member 470 extends), a first arm portion 476 extending from one end of the elastic portion 472, and a second arm portion 474 extending from the other end of the elastic portion 472. Moreover, in the board-side connection member 470*b*, the first arm portion 476 is bent on the way toward the rear of the paper surface, and the second arm portion 474 is bent on the way toward the front of the paper surface. In addition, the other board-side connection member 470*a* has a shape along a predetermined plane (paper surface).

The elastic portion 472 has a first bent point 472*a* and a second bent point 472*b*. The elastic portion 472 is extensible as the distance between the first and second bent points 472*a* and 472*b* is changed by an external force.

As illustrated in FIG. 13B, a positioning member 144 is provided on the bottom face 16*a* of the second case 16. The positioning member 144 is provided with a holding portion 146 for holding the board-side connection member 470. The holding portion 146 is a groove provided in the positioning member 144. As the elastic portion 472 is mounted in the holding portion 146, the board-side connection member 470 is held by the positioning member 144. Specifically, as the elastic portion 472 is mounted on the holding portion 146, the distance between the first and second bent points 472*a* and 472*b* is increased further than that when there is no load, so that the elastic portion 472 nips the positioning member 144. Accordingly, the board-side connection member 470 is held by the positioning member 144.

As illustrated in FIG. 13C, the board-side connection member 470 is held by the positioning member 144, on the first plane parallel to the bottom face 16*a*, the part 464*p* (the first site 464*p*) of the second arm portion 474 is positioned in the first region 640. That is, by changing a formation position of the holding portion 146 with respect to the positioning member 144, a position of the first site 464*p* on the first plane can be changed. Here, similarly to the first embodiment, the first region 640 is a region where the upper portion 284 (FIG. 4) of the member contact portion 280 passes when the member contact portion 280 is stored in the second case 16. Therefore, as in the first embodiment, after the ink pack 14 is stored in the second case 16, an additional operation of causing the second arm portion 474 to come in contact with the member contact portion 280 is not needed, thereby enhancing the assembly efficiency of the ink cartridge 10*a*.

Figure 14A:
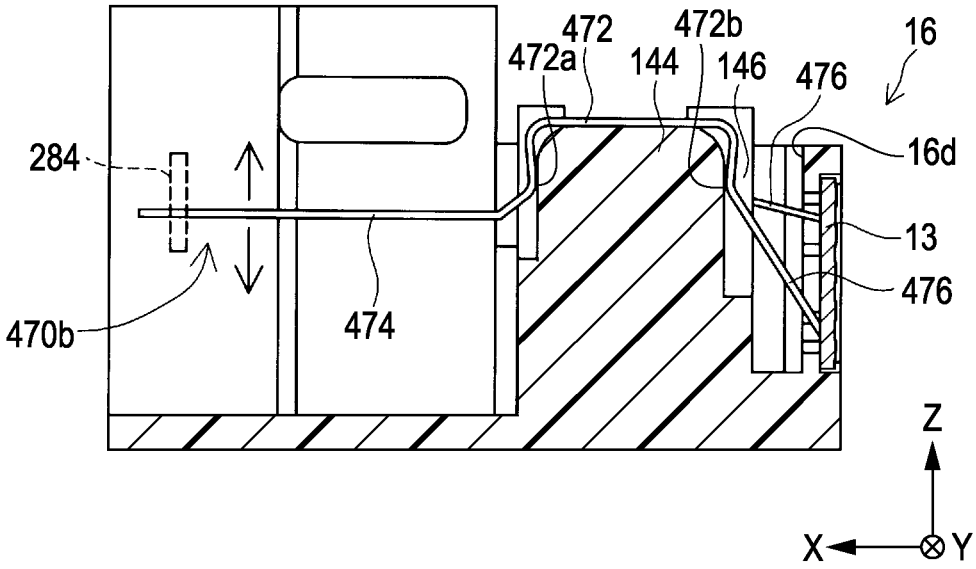
FIGS. 14A and 14B are diagrams illustrating a state where a board-side connection member is mounted.
Figure 14B:
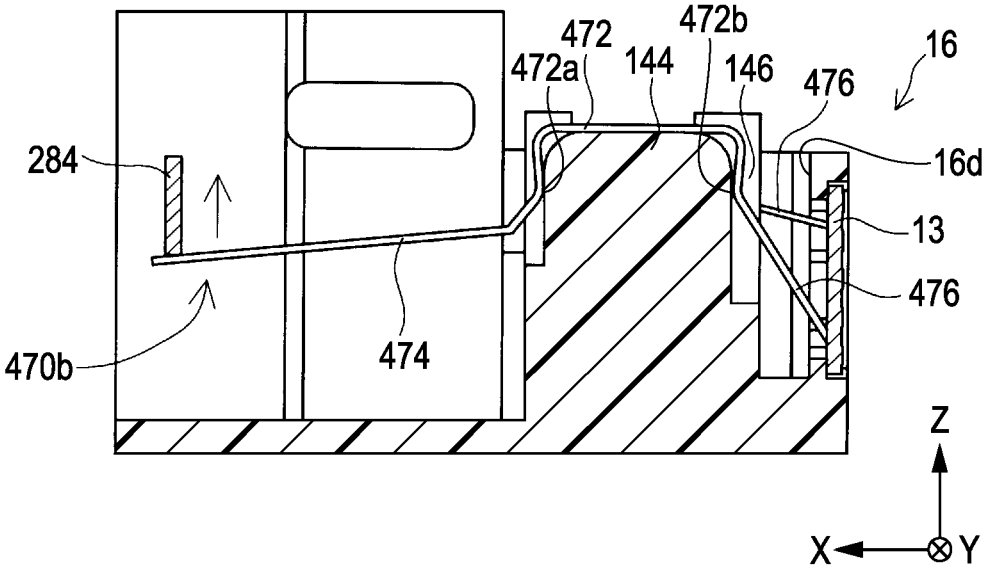

FIGS. 14A and 14B are diagrams illustrating a state where the board-side connection member 470 is mounted. FIG. 14A is a partial cross-sectional view taken along the line XIVA-XIVA of FIG. 13C in the state where the ink pack 14 is not stored in the second case 16. FIG. 14B is a partial cross-sectional view taken along the line XIVB-XIVB of FIG. 13C in a state where the ink pack 14 is stored in the second case 16 and the upper portion 284 (FIG. 4) of the sensor-side connection member 246 comes in contact with the second arm portion 474. Moreover, for the convenience of description, the board-side connection member 470*b* has a shape along a predetermined plane (the plane defined by the X- and Z-axes in FIGS. 14A and 14B) like the other board-side connection member 470*a*.

As illustrated in FIG. 14A, when the board-side connection member 470*b* is held by the positioning member 144, the distance between the first and second bent points 472*a* and 472*b* becomes greater than that when there is no load (FIG. 13A). Accordingly, the first arm portion 476 comes in contact with the board terminal 136*b* (FIG. 6B) of the circuit board 13. That is, as the elastic portion 472 is mounted in the holding portion 146, the elastic portion 472 grows than that when there is no load, so that one end side of the first arm portion 476 is displaced to come in contact with the board terminal 136*b*. Moreover, in the same manner, the other board-side connection member 470*a* is made to contact the board terminal 136*a* (FIG. 6B).

In addition, in the state where the board-side connection member 470*b* is held by the positioning member 144, by exerting an external force on the second arm portion 474, the second arm portion 474 elastically deforms along the vertical direction as illustrated by arrow directions. Moreover, as in the first embodiment, when the ink pack 14 is stored in the second case 16, the upper portion 284 is positioned at the point overlapping with the second arm portion 474.

As illustrated in FIG. 14B, when the ink pack 14 (FIG. 1) is stored in the second case 16, the upper portion 284 comes in contact with the second arm portion 474 and the upper portion 284 presses the second arm portion 474 against the bottom face 16*a*. The second arm portion 474 is likely to elastically deform in the arrow directions so as to return to the shape when there is no load. However, the upper portion 284 limits the elastic deformation thereof in the vertical direction. Accordingly, the second arm portion 474 exerts a predetermined load on the upper portion 284, so that failure of the conduction between the second arm portion 464 and the upper portion 284 can be reduced as in the first embodiment.

As described above, according to the second embodiment, as in the first embodiment, the position of the first site 464*p* can be determined by the holding portion 146 of the positioning member 144 (FIG. 13C), so that the second arm portion 464 and the member contact portion 280 can be easily made to contact each other. Therefore, the assembly efficiency of the ink cartridge 10 can be enhanced. In addition, by only mounting the elastic portion 472 on the holding portion 146, the second arm portion 464 is made to contact the board terminal, so that the assembly efficiency can further be enhanced than the first embodiment.

C. Modified Example

Moreover, among the components described in the embodiments, components other than the components described in the independent claims are additional components and thus suitably omitted. In addition, the invention is not limited to the embodiments or the examples, and various modifications can be made without departing from the spirit and scope of the invention. For example, modifications as follows can be made.

C-1. First Modified Example

According to the embodiments, the sensor terminal 267 for outputting the detection signal used for detecting the residual amount of ink and the board terminal 136 for outputting the drive signal to the sensor portion 260 are exemplified; however, the invention is not particularly limited thereto. A technique for conductively connecting two separating terminals with each other by a connection member may be applied to the invention. For example, as a terminal mounted on the ink pack, an output terminal for outputting a detection signal used for detecting temperature or density of ink may be employed. In addition, as a terminal mounted on the second case 16, an output terminal for outputting a drive signal to the output terminal may be employed.

C-2. Second Modified Example

Figure 15A:
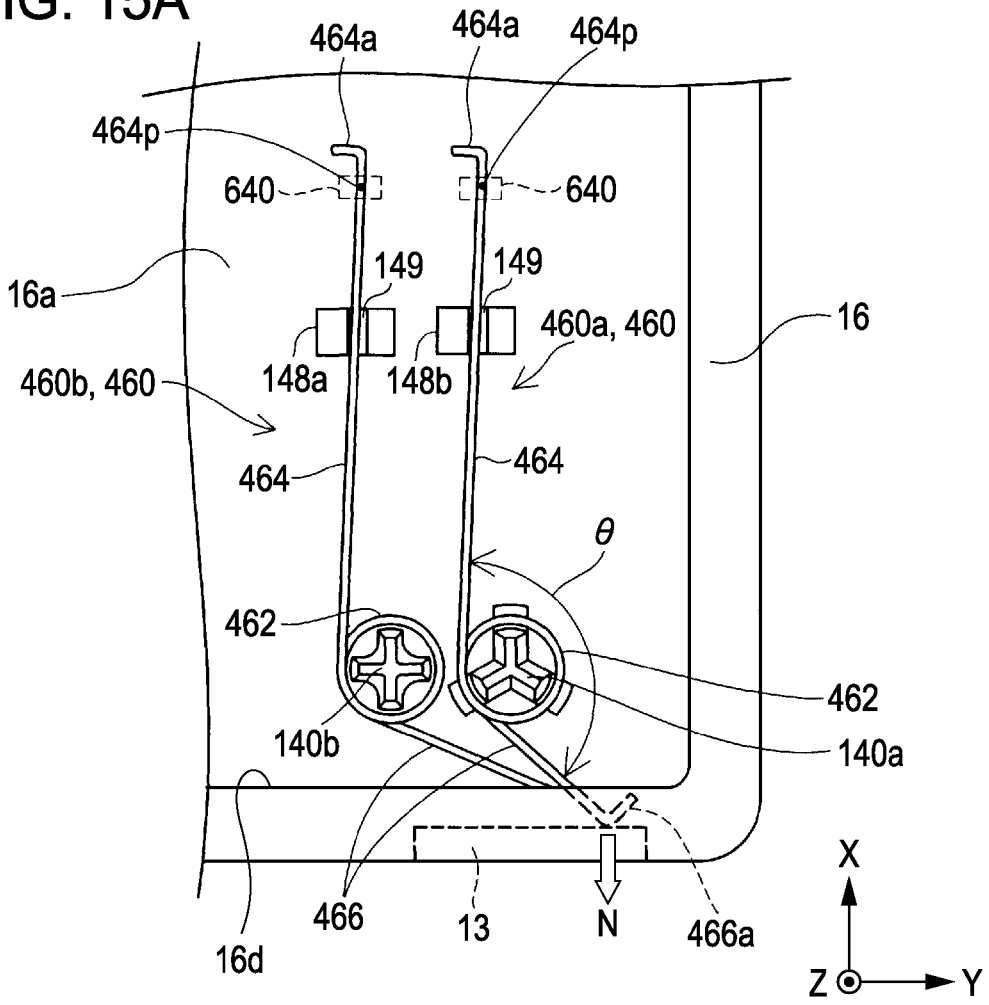
FIGS. 15A and 15B are diagrams illustrating a second modified example.
Figure 15B:
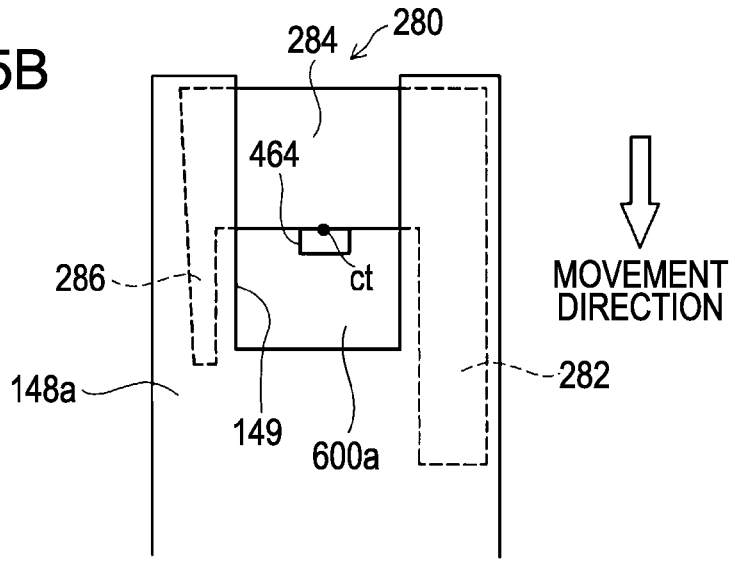

FIGS. 15A and 15B are diagrams illustrating a second modified example. FIG. 15A is a diagram of the second case 16 before being stored in the ink pack 14 as viewed in the Z-axis direction. FIG. 15B is a diagram schematically illustrating a predetermined region 600*a* viewed along the second arm portion 464 in a direction extending toward the member contact portion 280. Moreover, FIG. 15B is described using the second arm portion 464 which is inserted into a groove portion 149 of a second protruding portion 148*a*. However, the second arm portion 464 inserted into the groove portion 149 of the other second protruding portion 148*b* has the same relationship.

This example is different from the first embodiment in that the second protruding portions 148*a* and 148*b* which have different shapes from those of the second protruding portions 120*a* and 120*b* are provided on the second case 16 and thus a method of positioning the second arm portion 464 in the second case 16 is different. Other configurations (the ink pack 14, the first case 16, and the like) are the same as those of the first embodiment, and thus they are denoted by like reference numerals and description thereof will be omitted.

As illustrated in FIGS. 15A and 15B, the second protruding portions 148*a* and 148*b* according to the second modified example are rectangular protruding portions and are provided with the groove portions 149 on one side (the side opposed to the first case 12). By inserting the second arm portion 464 into the groove portion 149, in the state before the ink pack 14 is stored in the second case 16, the first site 464*p* of the second arm portion 464 can be positioned in the first region 640. Accordingly, as in the above embodiment, the second arm portion 464 and the member contact portion 280 are easily made to contact each other.

In addition, as illustrated in FIG. 15B, in the state where the ink cartridge 10 is stored in the second case 16, the predetermined region 600*a* is formed by the second protruding portion 148*a* and the member contact portion 280. The predetermined region 600*a* is a closed region enclosed by the second protruding portion 148*a* and the member contact portion 280. As such, even when an impact is exerted on the ink cartridge 10, a change in position of the second arm portion 464 with respect to the member contact portion 280 can be limited to a narrower range than that of the first embodiment. In other words, by the second protruding portion 148*a* and the member contact portion 280 which are in cooperation with each other, the movement of the second arm portion 464 can be limited to the narrower range. Accordingly, failure of the conduction between the member contact portion 280 and the second arm portion 464 can further be reduced.

C-3. Third Modified Example

In the above embodiments, the ink cartridge used for the printer as the liquid storage container is exemplified. However, the invention is not limited thereto, and the inter-terminal connection structure and the liquid storage container may be used for various types of liquid ejecting apparatuses.

Particular examples of the liquid ejecting apparatus include apparatuses having color material ejecting heads such as liquid crystal displays, apparatuses having heads for ejecting electrode materials (conductive paste) used for forming electrodes such as used organic light-emitting displays or surface-emitting displays (FEDs), apparatuses having head for ejecting biological organic materials used for manufacturing biochips, apparatuses having specimen ejecting heads as precision pipettes, printing apparatuses, and micro-dispensers.

In order to use the liquid storage container for the various types of liquid ejecting apparatuses, liquid corresponding to kinds of liquid to be ejected by the various types of liquid ejecting apparatuses may be stored in the liquid storage unit 18.

In addition, the manufacturing method according to the embodiments of the invention may be applied to liquid storage containers storing various kinds of liquid. As the various kinds of liquid, for example, there are liquids (color materials, conductive paste, biological organic materials, and the like) ejected by the various types of liquid ejecting apparatuses.

What is claimed is:

1. A liquid container for supplying liquid to a liquid ejecting apparatus having a terminal, the liquid container comprising:

a liquid container main body;

a liquid storage accommodated in the liquid container main body;

a liquid supply unit provided with the liquid storage;

a liquid supply unit positioning portion configured to position the liquid supply unit, wherein the liquid storage is moved in a direction perpendicular to a bottom face of the liquid container so that a part of the liquid supply unit is inserted into the supply unit positioning portion when the liquid supply unit is stored in the liquid container main body;

a first terminal arranged on the liquid storage;

a circuit board arranged on the liquid container main body;

a second terminal arranged on the circuit board and is configured to be electrically connected with the terminal of the liquid ejecting apparatus;

a first connection member which is electrically connected with the first terminal;

a second connection member which is electrically connected with the second terminal and the first connection member;

a positioning member configured to position the second connection member.

2. The liquid container of claim 1, wherein the first connection member has a terminal contact portion and a member contact portion and is bent between the terminal contact portion and the member contact portion.

3. The liquid container of claim 2, wherein the second connection member has bent portion.

4. The liquid container of claim 3, wherein the positioning member configured to position the second connection member in a thickness direction of the liquid container main body and a direction parallel to at least a face of the liquid container.

5. The liquid container of claim 4, wherein when the liquid storage is stored in the liquid container main body, the terminal contact portion is parallel to the bottom face.

6. A liquid container for supplying liquid to a liquid ejecting apparatus having a terminal, the liquid container comprising:

a liquid container main body;

a liquid storage accommodated in the liquid container main body;

a first terminal arranged on the liquid storage;

a circuit board arranged on the liquid container main body;

a second terminal arranged on the circuit board and is configured to be electrically connected with the terminal of the liquid ejecting apparatus;

a first connection member which is electrically connected with the first terminal;

a second connection member which is electrically connected with the second terminal and the first connection member;

a first positioning member configured to position the second connection member; and at least a second positioning member configured to maintain at least one connection member at a constant relative angle.

7. The liquid container of claim 6, further comprising:

a liquid supply unit provided with the liquid storage;

a liquid supply unit positioning member configured to position the liquid supply unit, wherein the liquid storage is moved in a direction perpendicular to at least a face of the liquid container main body so that a part of the liquid supply unit is inserted into the supply unit positioning member when the liquid storage supply unit is stored in the liquid container main body.

8. The liquid container of claim 7, wherein the first connection member has a terminal contact portion and a member contact portion and is bent between the terminal contact portion and the member contact portion.

9. The liquid container of claim 8, wherein the second connection member has bent portion.

10. The liquid container of claim 9, wherein the positioning member configured to position the second connection member in a thickness direction of the liquid container main body and a direction parallel to the at least a face of the liquid container.

11. The liquid container of claim 10, wherein when the liquid storage is stored in the liquid container main body, the terminal contact portion is parallel to the at least a face of the liquid container.

* * * * *